US006879794B2

(12) United States Patent
Azuma et al.

(10) Patent No.: US 6,879,794 B2
(45) Date of Patent: Apr. 12, 2005

(54) IMAGE FORMING APPARATUS

(75) Inventors: Jun Azuma, Osaka (JP); Ayako Yashima, Osaka (JP); Yukimasa Watanabe, Osaka (JP); Keisuke Oba, Osaka (JP); Masashi Fujishima, Osaka (JP); Takashi Nagashima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/074,021

(22) Filed: Feb. 14, 2002

(65) Prior Publication Data

US 2002/0159804 A1 Oct. 31, 2002

(30) Foreign Application Priority Data

Feb. 28, 2001 (JP) ..... 2001-054400
Mar. 7, 2001 (JP) ..... 2001-063368

(51) Int. Cl.[7] ..... G03G 15/00

(52) U.S. Cl. ..... 399/159; 399/350; 430/96; 430/125

(58) Field of Search ..... 399/350, 388, 399/159, 98; 430/96, 66

(56) References Cited

U.S. PATENT DOCUMENTS 5,060,014 A * 10/1991 Adachi et al. ..... 399/350
5,114,814 A * 5/1992 Sakoh et al. ..... 399/350
5,532,101 A * 7/1996 Nozawa et al. ..... 399/350
5,604,574 A * 2/1997 Matsuura et al. ..... 399/350
5,721,085 A * 2/1998 Oshiba et al. ..... 399/350
5,740,498 A * 4/1998 Tsuchiya ..... 399/98
6,451,493 B1 * 9/2002 Omokawa et al. ..... 430/56
2002/0076238 A1 * 6/2002 Itami et al. ..... 399/350

OTHER PUBLICATIONS

Borsenberger, Paul M. et al. Organic Photoreceptors for Imaging Systems. New York: Marcel–Dekker, Inc. (1993) pp. 6–17, 28 31.*

* cited by examiner

*Primary Examiner*—Christopher Rodee
(74) *Attorney, Agent, or Firm*—Smith, Gambrell & Russell LLP

(57) ABSTRACT

Disclosed are image forming apparatus [1] which comprises removing a toner remained on the surface of the rotatable image carrier by cleaning means after going through developing means and transferring means; said cleaning means has an elastic blade and is contacted with the surface of the image carrier at a contact pressure within 8 to 20 g/cm, and a press-contact angle of the elastic blade of 12 to 30°; and said image carrier is an organic photosensitive material having a photosensitive layer made of a binder resin containing an electric charge generating material and an electric charge transferring material; and image forming apparatus [2], comprising a single-layer type photosensitive layer made of a binder resin containing an electric charge generating material, an electron transferring material and a hole transferring material, and the solid content of the binder resin is within 50 to 70 wt % of the whole solid content in the photosensitive layer and, a pair of paper transporting rollers are arranged on a path for transporting a transfer paper from paper feeding portion to transferring means, and a paper transporting roller at the side of the surface to be transferred among a pair of paper transporting rollers has cleaning means at the side of the surface to be transferred from the roller.

11 Claims, 11 Drawing Sheets

IMAGE FORMING APPARATUS

BACKGROUND OF THE INVENTION

The present invention relates to an image forming apparatus such as electrostatic copying machine, facsimile, laser beam printer or the like. More particularly, the present invention relates to an image forming apparatus equipped with an organic photosensitive material drum having good wear resistance and a cleaning means having an elastic blade, which causes neither "dash mark", "toner filming", "blade squeaking", nor "blade turning-over", and also has "long lifetime".

In the image forming apparatus described above, an electrophotosensitive material is used in the step of repeating a charging means, an exposing means, a developing means, a transferring means and a cleaning means in the image forming process. A latent image formed by the charging means and the exposing means is developed with a toner as powders in the form of fine particles. Although the developed toner is transferred onto a transfer material such as paper in the transferring means, the whole toner (100%) is not transferred and a portion of the toner is remained on the surface of the photosensitive material. When the residual toner is not removed, a high-grade image free from contamination can not be obtained in the repeating process. Therefore, cleaning of the residual toner is required. Transfer papers set in the paper feeding portion such as paper feeding cassette are sent to a transfer paper transporting path through paper feeding rollers and then transported toward an image forming portion through transportating roller and resist rollers arranged on the transfer paper transporting path, where an image is formed.

Typical examples of the cleaning means include those using a far brush, a magnetic brush, an elastic blade or the like. In view of the cleaning accuracy and rationalization of the constitution of the apparatus, a cleaning means for cleaning by directly contacting a blade-shaped resin plate with a photosensitive material using an elastic blade is generally selected.

In the image forming apparatus described above, various photosensitive materials having sensitivity at a wavelength range of a light source used in the apparatus are used. One of them is an inorganic photosensitive material using an inorganic material such as selenium in a photosensitive layer and the other is an organic photosensitive material (OPC) using an organic photosensitive material in a photosensitive layer. Among these photosensitive materials, the organic photosensitive material has widely been developed because of its easy production, wide range of choice of photosensitive materials such as electric charge transferring material, electric charge generating material and binder resin, and high functional design freedom as compared with the inorganic photosensitive material.

The organic photosensitive material includes, for example, a so-called multi-layer type photosensitive material having a multi-layer structure comprising an electric charge generating layer containing an electric charge generating material and an electric charge transferring layer containing an electric charge transferring material, and a so-called single-layer type photosensitive material wherein an electric charge generating material and an electric charge transferring material are dispersed in a single photosensitive layer. Among these photosensitive materials, the multi-layer type photosensitive material widely controls a market.

The single-layer type photosensitive material has attracted special interest recently since it has advantages that the productivity is excellent because of simple layer constitution, film defects of the photosensitive layer can be prevented from occurring because of less interfaces between layers, and one photosensitive material can be used in positively and negatively charging types by using an electron transferring material in combination with a hole transferring material as the electric charge transferring material.

As described above, the cleaning means using the elastic blade removes the residual toner on the surface of the organic photosensitive material by contacting the blade-shaped resin plate with the surface of the organic photosensitive material. It has been known that, when a force of press-contacting the elastic blade with the surface of the organic photosensitive material (linear pressure of blade) or an angle between the elastic blade to be contacted with the surface of the organic photosensitive material (press-contact angle of blade) is small, the residual toner passes through a microspace between the elastic blade with the surface of the organic photosensitive material in the pressed state and is fused strongly on the surface of the organic photosensitive material in the state where toner particles are collapsed, thereby to cause phenomena referred to as "dash mark" and "toner filming", and that optical attenuation does not occur because light is screened, thereby to cause image defects.

One of significant causes for dash mark and toner filming includes, for example, paper powders produced from the transfer paper. In case the transfer paper passes through various transporting rollers such as paper feeding rollers and resist rollers, paper powders are produced by friction with the rollers.

Fillers such as talc contained in the paper powders are negatively charged. In a reversal development type image forming apparatus using a positively charging single-layer type photosensitive material, since a negative bias is applied in the transferring portion, the paper powders are liable to be separated from the transfer paper and are attracted to the surface of the positively charged single-layer type photosensitive material by an electrostatic attraction. The paper powders adhered are adhered or fused on the surface of the photosensitive material more strongly by sliding friction of the blade and function as an inducer for dash mark and toner filming.

To improve the cleaning performance, thereby to prevent dash mark and toner filming from occurring, when the linear pressure or press-contact angle of the blade is enhanced, there sometimes arise a phenomenon referred to as "blade squeaking" wherein the elastic blade causes resonance sound on sliding friction of the surface of the organic photosensitive material, and a phenomenon referred to as "blade turning-over" wherein the blade deforms in waves or rotates in the same rotation direction as that of the drum.

In case a mechanical load on the surface of the organic photosensitive material increases and the wear amount of the photosensitive layer increases, problems such as lowering of chargeability and sensitivity occurs at an early stage, thereby making it difficult to obtain a high-grade image, and thus a so-called "long-lifetime" image forming apparatus can not be obtained.

An object of the present invention is to provide an image forming apparatus equipped with an organic photosensitive material drum as an image carrier and a cleaning means having an elastic blade, which causes neither "dash mark", "toner filming", "blade squeaking", nor "blade turning-over", and also has "long lifetime". Another object of the present invention is to specify a binder resin structure of the organic photosensitive material drum, thereby achieving longer lifetime of the image forming apparatus.

SUMMARY OF THE INVENTION

The present inventors have intensively studied to solve the problems described above and found that an image forming apparatus, comprising a rotatable image carrier, and a charging means, an exposing means, a developing means, a transferring means and a cleaning means, which are sequentially arranged in the vicinity of the rotatable image carrier, wherein a toner remained on the surface of the rotatable image carrier is removed by the cleaning means after going through the developing means and the transferring means; the cleaning means has an elastic blade, which is supported by a supporting member and is contacted with the surface of the image carrier at a contact pressure of not less than 8 g/cm and not more than 20 g/cm in terms of a linear pressure, and a press-contact angle of the elastic blade is not less than 12° and not more than 30°; and the image carrier is an organic photosensitive material comprising a conductive substrate, and a photosensitive layer made of a binder resin containing at least an electric charge generating material and an electric charge transferring material, which is formed on the conductive substrate, is less likely to cause dash mark, toner filming, blade squeaking and blade turning-over and also has long lifetime because of good wear resistance of the organic photosensitive material.

Also they have found that, in case the linear pressure is not less than 10 g/cm and not more than 18 g/cm or the press-contact angle is not less than 15° and not more than 25°, there is exerted a further effect of preventing dash mark, toner filming, blade squeaking and blade turning-over from occurring and preventing the organic photosensitive material from skiving.

Also the present inventors have found that an image forming apparatus, comprising a rotatable image carrier, and a charging means, an exposing means, a developing means, a transferring means and a cleaning means, which are sequentially arranged in the vicinity of the rotatable image carrier, wherein the cleaning means has an elastic blade contacted with the surface of the image carrier, and wherein the image carrier is an electrophotosensitive material comprising a conductive substrate, and a single-layer type photosensitive layer made of a binder resin containing at least an electric charge generating material, an electron transferring material and a hole transferring material, which is formed on the conductive substrate, and the solid content of the binder resin is not less than 50% by weight and not more than 70% by weight based on the whole solid content in the photosensitive layer and, moreover, a pair of paper transporting rollers are arranged on a path for transporting a transfer paper from a paper feeding portion to the transferring means, and a paper transporting roller at the side of the surface to be transferred among a pair of paper transporting rollers has a cleaning means for removing paper powders adsorbed on the paper transporting roller at the side of the surface to be transferred from the roller, has good wear resistance of the photosensitive material to be used and causes neither dash mark nor toner filming, and also has long lifetime.

Also they have found that, in case the organic photosensitive material as the image carrier contains, as the binder resin of the outermost layer, a copolymerized polycarbonate resin having a repeating structural unit represented by the general formula [1] and a repeating structural unit represented by the general formula [2], or a copolymerized polycarbonate resin having a repeating structural unit represented by the general formula [1], a repeating structural unit represented by the general formula [2] and a repeating structural unit represented by the general formula [3], it is particularly effective to prevent dash mark, toner filming, blade squeaking and blade turning-over, thereby to markedly improve the wear resistance of the photosensitive material, and thus longer lifetime can be achieved.

General Formula [1]

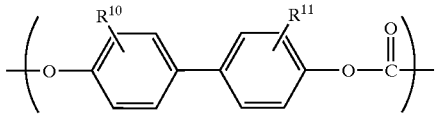

wherein $R^{10}$ and $R^{11}$ are the same or different and represent a hydrogen atom or an alkyl group having 1 to 3 carbon atoms General Formula [2]

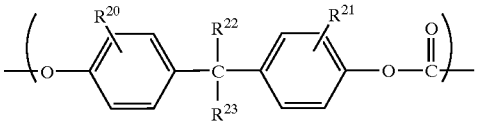

wherein $R^{20}$ and $R^{21}$ are the same or different and represent a hydrogen atom, an alkyl group having 1 to 3 carbon atoms, or a phenyl group and $R^{22}$ and $R^{23}$ are the same or different and represent an alkyl group having 1 to 3 carbon atoms, a phenyl group, or a cycloalkylidene group which may form a ring to have a substituent General Formula [3]

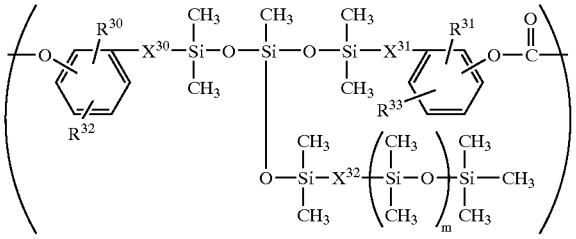

wherein $X^{30}$, $X^{31}$ and $X^{32}$ are the same or different and represent —$(CH_2)_n$— (n represents an integer of 1 to 6), $R^{30}$, $R^{31}$, $R^{32}$ and $R^{33}$ are the same or different and represent a hydrogen atom, a phenyl group, or an alkyl or alkoxy group having 1 to 3 carbon atoms, and m represents a numerical value of 0 to 200

Also they have found that it is effective that, in the electrophotosensitive material, the binder resin of the outermost layer contains, as a main component, a polycarbonate resin having a repeating structural unit represented by the general formula [4]:

General Formula [4]

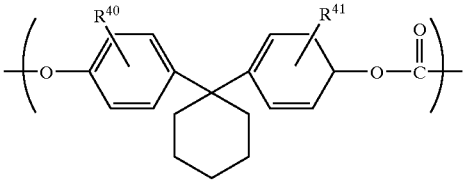

wherein $R^{40}$ and $R^{41}$ are the same or different and represent a hydrogen atom or an alkyl group having 1 to 3 carbon atoms, provided that $R^{40}$ and $R^{41}$ are not simultaneously hydrogen atoms.

The image forming apparatus of the present invention has a feature that it comprises a rotatable image carrier, and a charging means, an exposing means, a developing means, a transferring means and a cleaning means, which are sequentially arranged in the vicinity of the rotatable image carrier, wherein a toner remained on the surface of the rotatable image carrier is removed by the cleaning means after going through the developing means and the transferring means; the cleaning means has an elastic blade, which is supported by a supporting member and is contacted with the surface of the image carrier at a contact pressure of not less than 8 g/cm and not more than 20 g/cm in terms of a linear pressure, and a press-contact angle of the elastic blade is not less than 12° and not more than 30°; and the image carrier is an organic photosensitive material comprising a conductive substrate, and a photosensitive layer made of a binder resin containing at least an electric charge generating material and an electric charge transferring material, which is formed on the conductive substrate.

It is preferred that the linear pressure is not less than 10 g/cm and not more than 18 g/cm, or the press-contact angle is not less than 15° and not more than 25°.

When the linear pressure of the elastic blade is less than 8 g/cm or the press-contact angle is less than 12°, although the wear resistance of the organic photosensitive material is improved and lowering of the chargeability and sensitivity is less likely to occur, dash mark and toner filming occur frequently. On the other hand, when the linear pressure of the elastic blade is more than 20 g/cm or the press-contact angle is more than 30°, although dash mark and toner filming do not occur, a large torque is required to rotate the photosensitive material and thus blade squeaking and blade turning-over occur frequently and the wear resistance of the organic photosensitive material is also drastically lowered, thereby making it impossible to achieve longer lifetime.

The single-layer type photosensitive material used in the image forming apparatus of the present invention has a feature that it comprises a conductive substrate, and a single-layer type photosensitive layer made of a binder resin containing at least an electric charge generating material, an electron transferring material and a hole transferring material, which is formed on the conductive substrate, and the solid content of the binder resin is not less than 50% by weight and not more than 70% by weight based on the whole solid content in the photosensitive layer.

As a result of an intensively study about factors, which exert an influence on the wear resistance of the photosensitive material, it has been found that the influence of the solid content of the binder resin is drastically exerted on the wear resistance and a single-layer type photosensitive material having excellent wear resistance can be obtained by controlling the solid content of the binder resin to not less than 50% by weight and not more than 70% by weight based on the whole solid content without lowering an initial sensitivity.

The single-layer type photosensitive material used in the image forming apparatus of the present invention comprises a charging means, an exposing means, a developing means, a transferring means and a cleaning means, which are sequentially arranged in the vicinity of a rotatable image carrier, wherein the cleaning means has an elastic blade contacted with the surface of the image carrier, and a pair of paper transporting rollers are arranged on a path for transporting a transfer paper from a paper feeding portion to the transferring means, and a paper transporting roller at the side of the surface to be transferred among a pair of paper transporting rollers has a cleaning means for removing paper powders adsorbed on the paper transporting roller at the side of the surface to be transferred from the roller, namely, a paper powders removing means.

According to the paper powders removing means, since the paper powders are efficiently removed on the transfer paper transporting path and are not transformed to the transferring portion, the amount of the paper powders adhered onto the surface of the photosensitive material at the transferring portion is small and an inducer for dash mark and toner filming is not produced. Therefore, even if the image carrier is made of a photosensitive material having good wear resistance, neither dash mark nor toner filing is not caused by the paper powders.

The organic photosensitive material as the image carrier preferably contains, as the binder resin of the outermost layer, a copolymerized polycarbonate resin having a repeating structural unit represented by the general formula [1] and a repeating structural unit represented by the general formula [2], or a copolymerized polycarbonate resin having a repeating structural unit represented by the general formula [1], a repeating structural unit represented by the general formula [2] and a repeating structural unit represented by the general formula [3].

The repeating structural unit represented by the general formula [1] is remarkably effective to improve the wear resistance of the photosensitive layer because of high molecular stiffness. The repeating structural unit represented by the general formula [3] is effective to improve the wear resistance of the photosensitive layer because it has a siloxane bond on a main chain, and is particularly effective to reduce a friction coefficient of the cleaning blade to the surface of the photosensitive layer. Therefore, it is also effective to prevent blade squeaking and blade turning-over. Since it lowers the surface energy of the photosensitive layer, fusion of the toner is less likely to occur.

However, the polycarbonate resin having the repeating structural unit represented by the general formula [1] or [3] has a drawback that electrical characteristics such as chargeability and sensitivity of the photosensitive material slightly become inferior because of poor solvent solubility and poor compatibility with the electric charge transferring material. Therefore, use of the polycarbonate resin having the repeating structural unit represented by the general formula [2] due to copolyemerization markedly improve the solvent solubility and compatibility with the electric charge transferring material, thereby improving the electrical characteristics.

The image forming apparatus of the present invention can be preferably used in case the organic photosensitive material as the image carrier is a single-layer type photosensitive material. In case of a multi-layer type photosensitive material (negatively charging type), regarding the electric charge transferring layer to be contacted with the cleaning blade, a hole transferring material is merely molecular-dispersed in the binder resin. On the other hand, since the single-layer type photosensitive material simultaneously contains the electric charge generating material, the hole transferring material and the electron transferring material in the binder resin, as described above, and the content of a molecular-dispersed low-molecular weight compound is large and the electric charge generating material is particle-dispersed, the surface lubricity of the photosensitive layer is often lowered as compared with the multi-layer type photosensitive material and therefore blade squeaking and blade turning-over are likely to occur.

DETAILED DESCRIPTION OF THE INVENTION

[Cleaning Means of Image Forming Apparatus]

The image forming apparatus of the present invention has a feature that it comprises a rotatable image carrier, and a charging means, an exposing means, a developing means, a transferring means and a cleaning means, which are sequentially arranged in the vicinity of the rotatable image carrier, wherein a toner remained on the surface of the rotatable image carrier is removed by the cleaning means after going through the developing means and the transferring means; the cleaning means has an elastic blade, which is supported by a supporting member and is contacted with the surface of the image carrier at a contact pressure of not less than 8 g/cm and not more than 20 g/cm in terms of a linear pressure, and a press-contact angle of the elastic blade is not less than 12° and not more than 30°. Furthermore, it is preferred that the linear pressure is not less than 10 g/cm and not more than 18 g/cm, or the press-contact angle is not less than 15° and not more than 25°.

Figure 1:
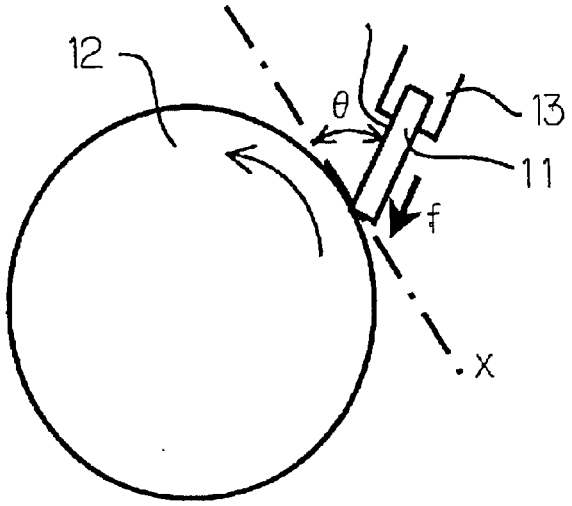
FIG. 1 is a partial explanatory view of an image forming apparatus of the present invention, showing the state where a cleaning blade is contacted with a photosensitive material.

In the cleaning means, in case an elastic blade is press-contacted with the surface of a rotating organic photosensitive material drum, a plate-like elastic blade 11 having a given thickness is supported by a supporting member 13 and a tip portion of the elastic blade 11 is generally press-contacted with the surface of the rotating organic photosensitive material drum 12, as shown in FIG. 1.

A press-contact angle θ of the elastic blade 11, which is formed between the contact surface 11*a* of the elastic blade 11 to be contacted with the organic photosensitive material drum 12 and a tangent line X of the organic photosensitive material drum 12 at its contact point at the side of a rotation direction of the organic photosensitive material drum 12, is set within a range from 12 to 30° and the press-contact force (linear pressure) of the elastic blade to the organic photosensitive material is set within a range from 8 to 20 g/cm.

To efficient scrape away the residual toner from the surface of the organic photosensitive material drum 12, the elastic blade 11 is preferably fluctuated in the axial direction of the organic photosensitive material drum 12. According to the kind of the organic photosensitive material drum 12, when a fixed position is continuously press-contacted with the elastic blade 11 for a long time, the contact portion sometimes causes image noise (blade press-contact indentation) in case of copying a half image. Therefore, when the organic photosensitive material drum 12 does not rotate, the blade may be separated from the organic photosensitive material drum 12 (blade separating/contacting).

The cleaning means of the image forming apparatus of the present invention is preferably applied at a peripheral speed of the organic photosensitive material 12 within a range 90 to 300 mm/sec. When the peripheral speed is not within the above range, the wear resistance and cleaning properties of the photosensitive layer change and, therefore, the cleaning conditions must be set again.

As described above, the image forming apparatus of the present invention comprises an exposing process, a charging process, a developing process, a transfer process and a cleaning process, which are sequentially arranged in the vicinity of a rotatable image carrier, wherein the cleaning process has an elastic blade contacted with the surface of the rotatable image carrier and, moreover, a pair of paper transporting rollers are arranged on a path for transporting a transfer paper from a paper feeding portion to the transferring means, and a paper transporting roller at the side of the surface to be transferred among a pair of paper transporting rollers has a cleaning means for removing paper powders adsorbed on the paper transporting roller at the side of the surface to be transferred from the roller, namely, a means for removing the paper powders from the transfer paper.

The cleaning means of the paper transporting rollers is preferably a system for removing paper powders adsorbed on the paper transporting roller by providing sponge rollers or brush rollers to be contacted with the paper transporting roller while being rotated with facing the rollers, or providing an elastic blade such as rubber, film or the like.

Since paper powders are efficiently removed by the paper powders removing means on the transfer paper transporting path and are not transported to the transferring portion, the amount of paper powders adhered on the surface of the photosensitive material at the transferring portion is small, thereby causing no image defects due to dash mark and toner filming.

The single-layer type photosensitive material used in the image forming apparatus of the present invention comprises a single-layer type photosensitive layer made of a binder resin containing at least an electric charge generating material, an electron transferring material and a hole transferring material, which is formed on the conductive substrate, and the solid content of the binder resin is not less than 50% by weight and not more than 70% by weight based on the whole solid content.

[Image Carrier of Image Forming Apparatus]

The image forming apparatus of the present invention is preferably used in case the image carrier is a single-layer type photosensitive material. The constituent materials will now be described by way of the single-layer type photosensitive material as the image carrier.

<Binder Resin>

As the binder resin, there can be used various resins which have conventionally used in the photosensitive layer. It is particularly preferred that the binder resin contains a copolymerized polycarbonate resin having a repeating structural unit represented by the general formula [1] and a repeating structural unit represented by the general formula [2], or copolymerized polycarbonate resin having a repeating structural unit represented by the general formula [1], a repeating structural unit represented by the general formula [2] and a repeating structural unit represented by the general formula [3]. Furthermore, the binder resin of the outermost layer preferably contains, as a main component, a polycarbonate resin having a repeating structural unit represented by the general formula [4].

In case the above copolymerized resins are incorporated, the binder resin may contain at least the copolymerized resin and can also contain various resins which have conventionally been used in the photosensitive layer.

As the resin which has conventionally been used in the photosensitive layer, there can be used, for example, thermoplastic resins such as styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, alkyd resin, polyamide, polyurethane, polyacrylate, diallyl phthalate resin, ketone resin, polyvinyl butyral resin, and polyether resin, including other polycarbonate resin, polyester resin and polyaryllate resin; crosslinkable thermosetting resins such as silicone resin, epoxy resin, phenol resin, urea resin, and melamine resin; and photocurable resins such as epoxy acrylate and urethane acrylate.

These binder resins can be used alone or in combination.

In case the photosensitive material contains a polycarbonate resin having a repeating structural unit represented by the general formula [1] or the general formula [3], the content of the repeating structural unit represented by the general formula [1] is preferably within a range from 10 to 50 mol % and the content of the repeating structural unit represented by the general formula [3] is preferably within a range from 0.05 to 10 mol %, based on the total amount of the binder resin. Although the wear resistance of the photosensitive layer is improved when the content of the repeating structural unit represented by the general formula [1] is more than 50 mol %, there arise problems that the solvent solubility and compatibility with the electric charge transferring material are lowered. Similarly, although the lubricity of the surface of the photosensitive layer is improved when the content of the repeating structural unit represented by the general formula [3] is more than 10 mol %, the sensitivity of the photosensitive material sometimes becomes inferior because the solvent solubility and compatibility with the electric charge transferring material are lowered.

On the other hand, when the content of the repeating structural unit represented by the general formula [1] is less than 10 mol % and the content of the repeating structural unit represented by the general formula [3] is less than 0.05 mol %, the effect of improving the wear resistance of the photosensitive layer and that of improving the lubricity of the surface of the photosensitive layer are lowered.

The weight-average molecular weight of the binder resin is preferably within a range from 10,000 to 400,000, and more preferably within a range from 30,000 to 200,000.

The solid content of the binder resin of the single-layer type photosensitive material used in the image forming apparatus of the present invention is preferably not less than 50% by weight and not more than 70% by weight, based on the whole solid content. Assumed that the single-layer type photosensitive material is composed only of an electric charge generating material, a hole transferring material, an electron transferring material and a binder resin, the solid content of the binder resin is calculated by the following equation.

[Solid content (% by weight) of binder resin]=[Content of binder resin]/[(Content of electric charge generating material)+(Content of hole transferring material)+(Content of electron transferring material)+(Content of binder resin)]×100

In the above formula, the content of the hole transferring material and that of the electron transferring material exert a large influence on the wear resistance of the photosensitive layer. These low-molecular weight compounds have an action like a plasticizer in the binder resin and the wear resistance of the photosensitive layer is lowered as the content increases. For example, when the content of the binder resin is 100 parts by weight, the content of the electric charge generating layer is 2.5 parts by weight, the sum total of the content of the hole transferring material and that of the electron transferring material is preferably not less than about 40 parts by weight and not more than about 95 parts by weight.

As the binder resin, a polycarbonate resin having a repeating structural unit represented by the general formula [4] can be preferably used in place of a polycarbonate resin having repeating structural units represented by the general formulas [1] to [3].

<Electric Charge Generating Material>

Examples of the electric charge generating material include conventionally known electric charge generating materials, for example, organic photoconductive materials such as phthalocyanine pigment (e.g. metal-free phthalocyanine, oxotitanyl phthalocyanine, hydroxy gallium phthalocyanine, etc.), perylene pigment, bisazo pigment, dithioketopyrrolopyrrole pigment, metal-free naphthalocyanine pigment, metallic naphthalocyanine pigment, squalane pigment, trisazo pigment, indigo pigment, azulenium pigment, cyanine pigment, pyrylium salt pigment, anthanthrone pigment, triphenylmethane pigment, threne pigment, toluidine pigment, pyrrazoline pigment, and quinacridone pigment; and inorganic photoconductive materials such as selenium, selenium-tellurium, selenium-arsenic, cadmium sulfide, and amorphous silicon. These electric charge generating materials can be used alone or in combination so that the resulting electrophotosensitive material has an absorption wavelength within a desired range.

Since digital optical image forming apparatuses such as laser beam and facsimile, which use a light source such as semiconductor laser, require a photosensitive material having a sensitivity at a wavelength of not less than 700 nm, the phthalocyanine pigment such as metal-free phthalocyanine, oxotitanyl phthalocyanine, hydroxy gallium phthalocyanine or the like is preferably used, among the electric charge generating materials described above. The crystal form of the phthalocyanine pigment is not specifically limited and phthalocyanine pigments having different crystal forms can be used.

The electric charge generating material is preferably incorporated in the amount within a range from 0.1 to 50% or more and 70% or less, and more preferably from 0.5 to 10% by weight, based on the weight of the whole binder resin.

<Electric Charge Transferring Material>

Examples of the electric charge transferring material include conventionally known electron transferring material and hole transferring material. In case of the single-layer type photosensitive material, a mixture of the hole transferring material and the electron transferring material is incorporated into the photosensitive layer to improve the sensitivity or charge stability.

<Hole Transferring Material>

Examples of the usable hole transferring material used include nitrogen-containing compounds and condensed polycyclic compounds such as N,N,N',N'-tetraphenylbenzidine derivative, N,N,N',N'-tetraphenylphenylenediamine derivative, N,N,N',N'-tetraphenylnaphthylenediamine derivative, N,N,N',N'-tetraphenylphenantolylenediamine derivative, oxadiazole compound [e.g. 2,5-di(4-methylaminophenyl)-1,3,4-oxadiazole], styryl compound [e.g. 9-(4-diethylaminostyryl) anthracene], carbazole compound [e.g. polyvinylcarbazole], organopolysilane compound, pyrazoline compound [e.g. 1-phenyl-3-(p-dimethylaminophenyl)pyrazoline], hydrazone compound, indole compound, oxazole compound, isoxazole compound, thiazole compound, thiadiazole compound, imidazole compound, pyrazole compound, and triazole compound.

It is particularly preferred that the hole transferring material contains a compound represented by the general formula [5], the general formula [6], the general formula [7] or the general formula [8].

General Formula [5]

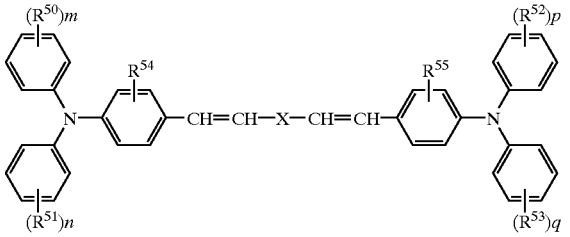

wherein $R^{50}$, $R^{51}$, $R^{52}$ and $R^{53}$ are the same or different and represent an alkyl group, an alkoxy group, an aryl group, an aralkyl group, or a halogen atom, m, n, p and q are the same or different and represent an integer of 0 to 3, $R^{54}$ and $R^{55}$ are the same or different and represent a hydrogen atom or an alkyl group, and —X— represents

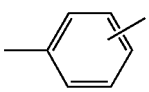

or

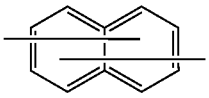

-continued

General Formula [6]

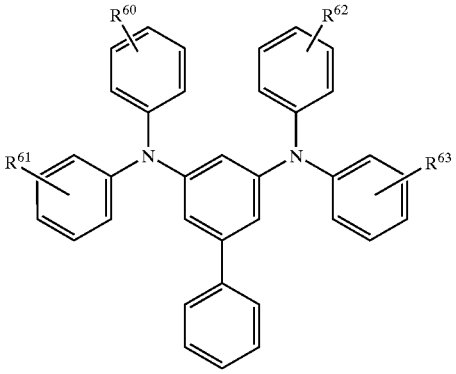

wherein $R^{60}$ and $R^{62}$ same or different and represent an alkyl group and represent an alkyl group which may have a substituent, and $R^{61}$ and $R^{63}$ are the same or different and represent an alkyl group and represent an alkyl group which has a substituent General Formula [7]

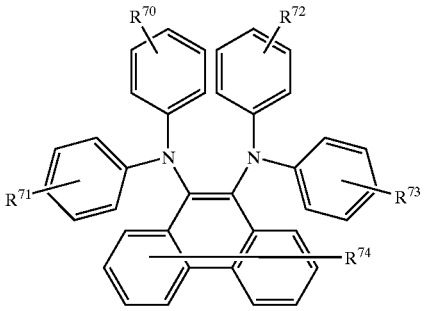

wherein $R^{70}$, $R^{71}$, $R^{72}$, $R^{73}$ and $R^{74}$ are the same or different and represent a hydrogen atom, a halogen atom, or an alkyl or alkoxy group which may have a substituent General Formula [8]

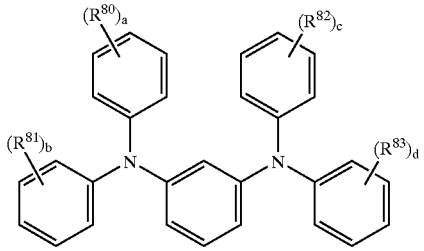

wherein $R^{80}$, $R^{81}$, $R^{82}$ and $R^{83}$ are the same or different and represent a halogen atom, or an alkyl, alkoxy or aryl group which may have a substituent, a, b, c and d are the same or different and represent an integer of 0 to 5, provided that $R^{80}$, $R^{81}$, $R^{82}$ and $R^{83}$ may be different when a, b, c or d is 2 or more The hole transferring material represented by the general formula [5], the general formula [6], the general formula [7] or the general formula [8] is effective to improve the sensitivity of the photosensitive material because it has very large mobility and is capable of efficiently transferring holes.

The hole transferring materials described above may be used alone or in combination.

<Electron Transferring Material>

Examples of the usable electron transferring materials include various compounds having electron attractive properties, for example, diphenoquinone derivative and benzoquinone derivative, azoquinone derivative described in Japanese Published Unexamined Patent Application (Kokai) Tokkyo Koho Nos. 2000-147806 and 2000-242009, monoquinone derivative described in Japanese Published Unexamined Patent Application (Kokai) Tokkyo Koho Nos. 2000-075520 and 2000-258936, dinaphthylquinone derivative, dimide tetracarboxylate derivative, imide carboxylate derivative, stilbenquinone derivative, anthraquinone derivative, malononitrile derivative, thiopyrane derivative, trinitrothioxanthone derivative, 3,4,5,7-tetranitro-9-fluorenone derivative, dinitroanthracene derivative, dinitroacridine derivative, nitroanthraquinone derivative, dinitroanthraquinone derivative, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, and dibromomaleic anhydride.

It is particularly preferred that the electron transferring material contains a compound represented by the general formula [9], the general formula [10], the general formula [11], the general formula [12], the general formula [13], the general formula [14] or the general formula [15].

General Formula [9]

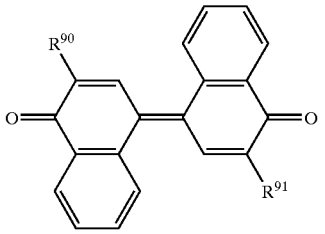

wherein $R^{90}$ and $R^{91}$ are the same or different and represent an alkyl group which may have a substituent General Formula [10]

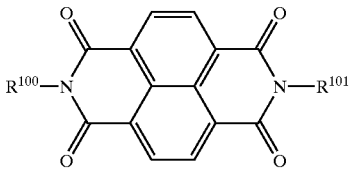

wherein $R^{100}$ and $R^{101}$ are the same or different and represent a monovalent hydrocarbon group which may have a substituent General Formula [11]

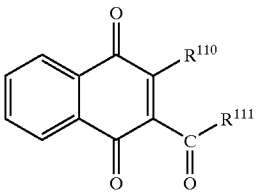

wherein $R^{110}$ represents a halogen atom, or an alkyl or aryl group which may have a substituent, $R^{111}$ represents an alkyl or aryl group which may have a substituent, or a group: —O—$R^{110a}$ ($R^{110a}$ represents an alkyl or aryl group which may have a substituent)

General Formula [12]

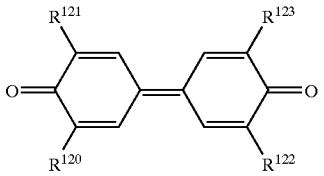

wherein $R^{120}$, $R^{121}$, $R^{122}$ and $R^{123}$ are the same or different and represent an alkyl group which may have a substituent General Formula [13]

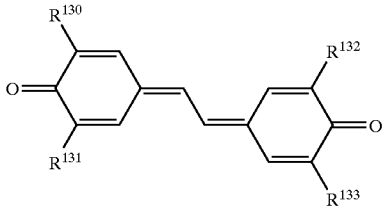

wherein $R^{130}$ to $R^{133}$ are the same or different and represent a hydrogen atom, or an alkyl group having 1 to 12 carbon atoms, an alkoxy group having 1 to 12 carbon atoms, an aryl group which may have a substituent, a cycloalkyl group, an aralkyl group which may have a substituent, or a halogenated alkyl group, and the substituent represents a halogen atom, an alkoxy group having 1 to 6 carbon atoms, a hydroxyl group, a cyano group, an amino group, a nitro group, or a halogenated alkyl group.

General Formula [14]

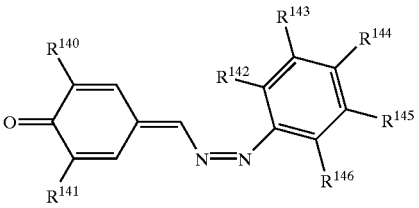

wherein $R^{140}$ and $R^{141}$ are the same or different and represent a hydrogen atom, an alkyl group having 1 to 12 carbon atoms, an alkoxy group having 1 to 12 carbon atoms, an aryl group which may have a substituent, a cycloalkyl group, an aralkyl group which may have a substituent, or a halogenated alkyl group, $R^{142}$ and $R^{146}$ are the same or different and represent a hydrogen atom, a halogen atom, an alkyl group having 1 to 12 carbon atoms, an alkoxy group having 1 to 12 carbon atoms, an aralkyl group which may have a substituent, a phenoxy group which may have a substituent, or a halogenated alkyl group, and two or more of them may be combined to form a ring, and the substituent represents a halogen atom, an alkyl group having 1 to 6 carbon atoms, an alkoxy group having 1 to 6 carbon atoms, a hydroxyl group, a cyano group, an amino group, a nitro group, or a halogenated alkyl group.

General Formula [15]

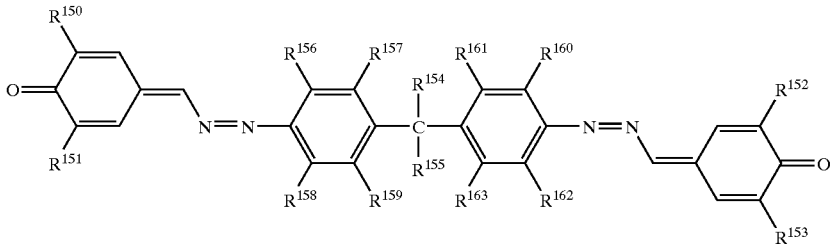

wherein $R^{150}$ and $R^{153}$ are the same or different and represent a hydrogen atom, an alkyl group having 1 to 12 carbon atoms, an alkoxy group having 1 to 12 carbon atoms, an aryl group which may have a substituent, a cycloalkyl group, an aralkyl group which may have a substituent, or a halogenated alkyl group, $R^{154}$ and $R^{155}$ are the same or different and represent a hydrogen atom or an alkyl group having 1 to 12 carbon atoms, $R^{156}$ to $R^{163}$ are the same or different and represent a hydrogen atom, an alkyl group having 1 to 12 carbon atoms, an alkoxy group having 1 to 12 carbon atoms, an aralkyl group which may have a substituent, or a halogenated alkyl group, and the substituent represents a halogen atom, an alkyl group having 1 to 6 carbon atoms, an alkoxy group having 1 to 6 carbon atoms, a hydroxyl group, a cyano group, an amino group, a nitro group, or a halogenated alkyl group.

The electron transferring material represented by the general formula [9], the general formula [10], the general formula [11], the general formula [12], the general formula [13], the general formula [14] or the general formula [15] is effective to improve the sensitivity of the photosensitive material because it has very large mobility and is capable of efficiently transferring electrons.

The electron transferring materials described above may be used alone or in combination.

The film thickness of the photosensitive layer is preferably within a range from about 5 to 100 μm, and more preferably from about 15 to 50 μm. The electric charge generating material is preferably incorporated in the amount within a range from 0.1 to 50% by weight, and more preferably from 0.5 to 30% by weight, based on the weight of the whole binder resin. The electron transferring material is preferably incorporated in the amount within a range from 1 to 100% by weight, and more preferably from 5 to 80% by weight, based on the weight of the whole binder resin. The hole transferring material is preferably incorporated in the amount within a range from 5 to 500% by weight, and more preferably from 25 to 200% by weight, based on the weight of the whole binder resin. The electron transferring material and hole transferring material are preferably incorporated in the total amount within a range from 20 to 500% by weight, and more preferably from 30 to 200% by weight, based on the weight of the whole binder resin.

Furthermore, the total amount of the electron transferring material and hole transferring material is most preferably within a range from 40 to 100% by weight based on the binder resin. Since the electric charge transferring material acts as a plasticizer in the binder resin, the wear resistance of the photosensitive layer is lowered when the content of the electric charge generating material increases. It is ideal that the solid content of the electric charge transferring material is reduced to improve the wear resistance, however, electrical characteristics such as charge repeating stability and sensitivity are lowered, necessarily.

By using an arbitrary electric charge transferring material having a large hole or electron transferability, such as compounds represented by the general formulas [5] to [15], a sufficient sensitivity can be obtained in case of the single-layer type photosensitive material even if the solid content of the electric charge transferring material is small such as 40 to 100% by weight based on the binder resin.

[Substrate and Formation of Photosensitive Layer]

As the substrate on which the photosensitive layer is formed, for example, various materials having the conductivity can be used. Examples thereof include metallic simple substances such as iron, aluminum, copper, tin, platinum, silver, vanadium, molybdenum, chromium, cadmium, titanium, nickel, palladium, indium, stainless steel, and brass; plastic materials prepared by depositing or laminating the above metal; and glasses coated with aluminum iodide, tin oxide, and indium oxide.

The substrate may be in the form of a drum and substrate itself may have the conductivity, or the surface of the substrate may have the conductivity. The conductive substrate may be preferably those having a sufficient mechanical strength when used.

When the photosensitive layer is formed by the coating method, a dispersion is prepared by dispersing and mixing the above electric charge generating material, electric charge transferring material, and binder resin, together with a proper solvent, using a known method such as roll mill, ball mill, attritor, paint shaker, and ultrasonic dispersing equipment, and then the resulting dispersion is coated by using a known means and dried.

As the solvent for preparing the dispersion, various organic solvents can be used. The organic solvent includes, for example, alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ethers such as dimethyl ether, diethyl ether, tetrahydrofuran, ethylene glycol dimethyl ether, and diethylene glycol dimethyl ether; ketones such as acetone, methyl ethyl ketone, and cylohexanone; esters such as ethyl acetate and methyl acetate; and dimethylformaldehyde, dimethylformamide, and dimethyl sulfoxide. These solvents can be used alone or in combination.

The film thickness of the photosensitive layer used in the image forming apparatus of the present invention is preferably within a range from about 5 to 100 μm, and particularly preferably from 30 to 50 μm.

The image carrier used in the image forming apparatus of the present invention is a cylindrical drum having a single-layer type photosensitive layer. In case the drum diameter is within a range from 55 to 85 mm and the drum peripheral speed is within a range from 250 to 300 mm/sec, the wear amount of the single-layer type photosensitive layer per drum driving time is preferably 0.002 μm/min or less. When the wear amount is more than 0.002 μm/min, the chargeability and sensitivity are lowered at an early stage and an image forming apparatus having long lifetime can not be obtained.

In addition to the above respective components, various conventionally known additives such as antioxidants, radical scavengers, singlet quenchers, deterioration inhibitors (e.g. ultraviolet absorbers), softeners, plasticizers, surface modifiers, extenders, thickeners, dispersion stabilizers, waxes, acceptors, and donors can be incorporated into the photosensitive material as far as these additives do not exert a deleterious influence on electrophotographic characteristics. To improve the sensitivity of the photosensitive layer, for example, known sensitizers such as terphenyl, halonaphthoquinones, and acenaphthylene may be used in combination with the electric charge generating material.

A barrier layer may be formed between the substrate and the photosensitive layer as far as it does not inhibits the characteristics of the photosensitive material.

To improve the dispersion properties of the electric charge generating material and electric charge transferring material and the smoothness of the surface of the photosensitive layer, for example, surfactants and leveling agents may be used.

[Effect of the Invention]

The present invention has the following effects.

The image forming apparatus, comprising a rotatable image carrier, and a charging means, an exposing means, a developing means, a transferring means and a cleaning means, which are sequentially arranged in the vicinity of the rotatable image carrier, wherein a toner remained on the surface of the rotatable image carrier is removed by the cleaning means after going through the developing means and the transferring means; the cleaning means has an elastic blade, which is supported by a supporting member and is contacted with the surface of the image carrier at a contact pressure of not less than 8 g/cm and not more than 20 g/cm in terms of a linear pressure, and a press-contact angle of the elastic blade is not less than 12° and not more than 30°; and the image carrier is an organic photosensitive material comprising a conductive substrate, and a photosensitive layer made of a binder resin containing at least an electric charge generating material and an electric charge transferring material, which is formed on the conductive substrate, is less likely to cause dash mark, toner filming, blade squeaking and blade turning-over and also has long lifetime because of good wear resistance of the organic photosensitive material.

In case the linear pressure is not less than 10 g/cm and not more than 18 g/cm or the press-contact angle is not less than 15° and not more than 25°, there was exerted a further effect of preventing dash mark, toner filming, blade squeaking and blade turning-over from occurring and preventing the organic photosensitive material from skiving.

In case the organic photosensitive material as the image carrier contains, as the binder resin of the outermost layer, a copolymerized polycarbonate resin having a repeating structural unit represented by the general formula [1] and a repeating structural unit represented by the general formula [2], or a copolymerized polycarbonate resin having a repeating structural unit represented by the general formula [1], a repeating structural unit represented by the general formula [2] and a repeating structural unit represented by the general formula [3], it is particularly effective to prevent dash mark, toner filming, blade squeaking and blade turning-over, thereby to markedly improve the wear resistance of the photosensitive material, and thus longer lifetime can be achieved.

The image forming apparatus, comprising a rotatable image carrier, and a charging means, an exposing means, a developing means, a transferring means and a cleaning means, which are sequentially arranged in the vicinity of the rotatable image carrier, wherein the cleaning means has an elastic blade contacted with the surface of the image carrier, and wherein the image carrier is an electrophotosensitive material comprising a conductive substrate, and a single-layer type photosensitive layer made of a binder resin containing at least an electric charge generating material, an electron transferring material and a hole transferring material, which is formed on the conductive substrate, and the solid content of the binder resin is not less than 50% by weight and not more than 70% by weight based on the whole solid content in the photosensitive layer and, moreover, a pair of paper transporting rollers are arranged on a path for transporting a transfer paper from a paper feeding portion to the transferring means, and a paper transporting roller at the side of the surface to be transferred among a pair of paper transporting rollers has a cleaning means for removing paper powders adsorbed on the paper transporting roller at the side of the surface to be transferred from the roller, has good wear resistance of the photosensitive material to be used and does not cause dash mark and toner filming, and also has long lifetime.

EXAMPLES

The following Examples and Comparative Examples further illustrate the present invention in detail. The following embodiments are illustrative, and they should not be construed to limit the technical scope of the present invention.

In the following Examples and Comparative Examples, the respective chemical formulas of ETM-1 used as the electron transferring material, HTM-1 used as the hole transferring material, and Resin-1, Resin-2, Resin-3 and Resin-4 used as the binder resin are shown below.

ETM-1

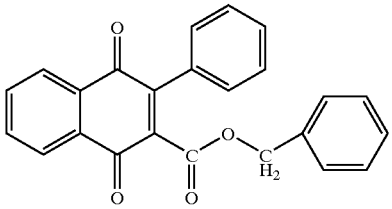

-continued
HTM-1
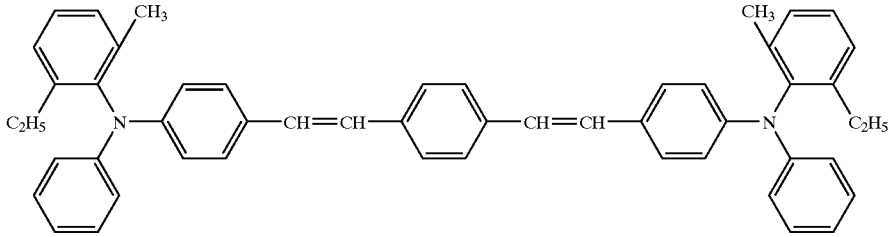
Resin-1
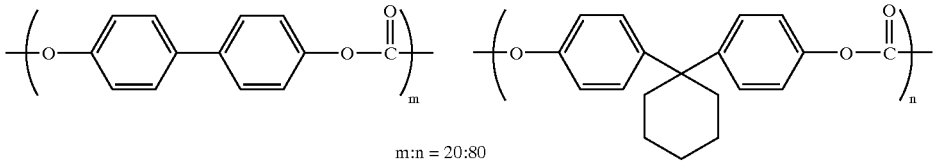
m:n = 20:80
Resin-2
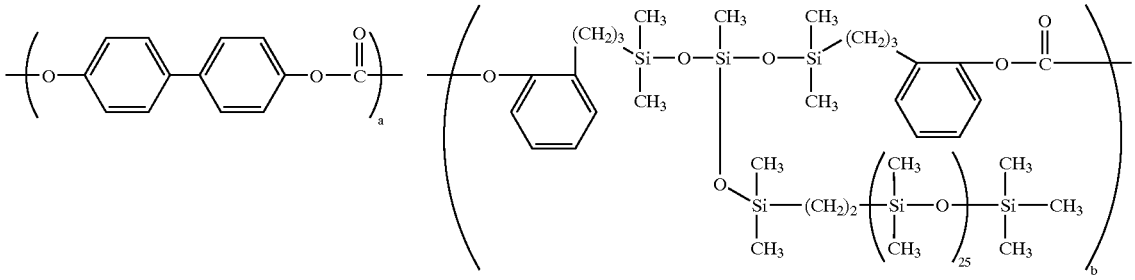
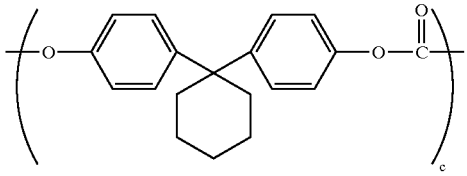
a:b:c = 20.0:0.1:79.9
Resin-3
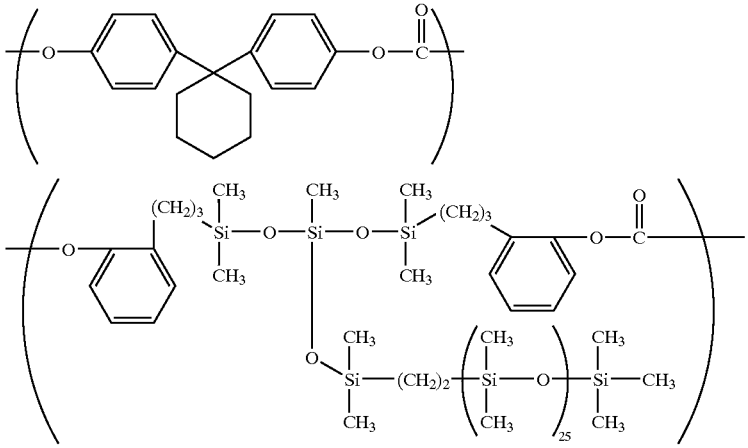
Resin-4
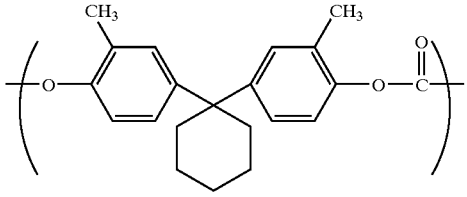

[Image Forming Apparatus 1]

Figure 2:
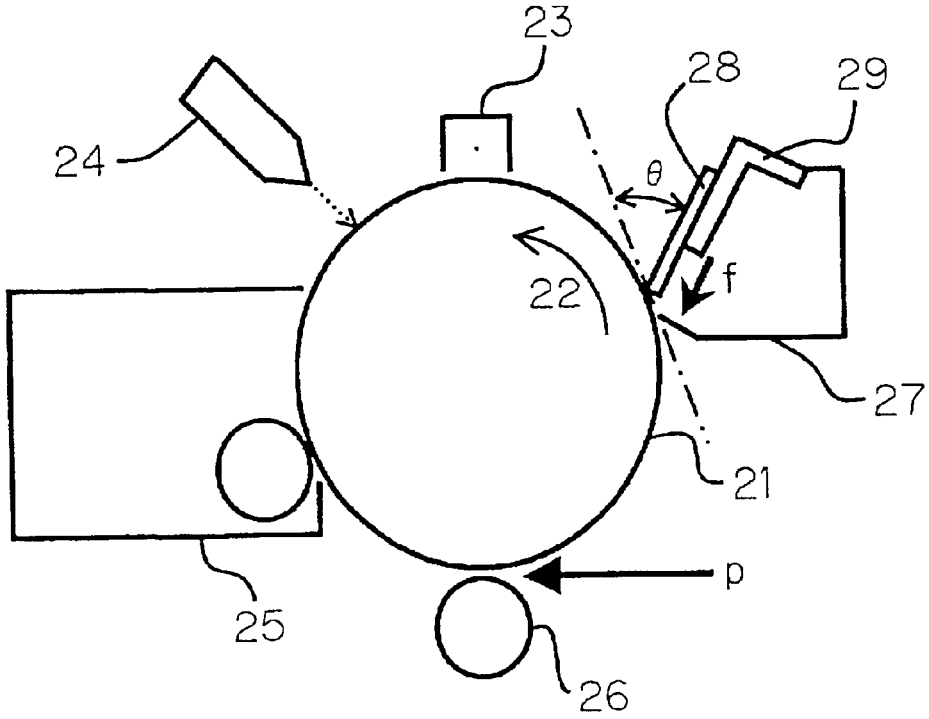
FIG. 2 is a cross-sectional view showing a simplified internal constitution of the image forming apparatus equipped with a blade system cleaning device of the present invention.

A schematic view of the image forming apparatus of the present invention equipped with a blade system cleaning device is shown in FIG. 2. This image forming apparatus is equipped with a photoconductor (positively charging type single-layer type OPC) or photosensitive material drum 21, which rotates in the direction of arrow 22. A main charger 23, an exposure device 24, a developing device 25, a transfer roller 26, and a cleaning device 27 equipped with a cleaning blade 28 are sequentially arranged in the vicinity of the photosensitive material drum 21 in the rotating direction 22.

During the image formation, the photosensitive material drum 21 is driven while rotating at a given speed (peripheral speed: 110 mm/sec) in the direction of arrow 22 and the surface of the photosensitive material drum 21 is positively charged to a predetermined potential (850 V) uniformly by discharge of the main charger 23. The positively charged surface faces the exposure device 24 by rotation of the photosensitive material drum 21 and then exposed to light corresponding to the image to be formed. Consequently, a high potential region and a low potential region arise on the surface of the photosensitive material drum 21 to form a so-called electrostatic latent image. When the photosensitive material drum 21 is further rotated, the electrostatic latent image faces the developing device 25 and then developed with the toner. When the toner image is positioned opposite to the transfer roller 26, the toner image is transferred onto a transported transfer paper P.

A portion of the toner is usually remained on the surface of the photosensitive material drum 21 without being transferred onto the transfer paper P. When the photosensitive material drum 21 is further rotated, the surface, on which the residual toner was adhered, faces the cleaning device 27, the residual toner is recovered by the cleaning device 27.

Specifically, the cleaning device 27 is equipped with a longitudinal cleaning blade 28 (made of an urethane rubber) in the axial direction of the photosensitive material drum 21, and a tip edge thereof is pressed against nearly the whole width of the surface of the photosensitive material drum 21. The residual toner is scraped away from the surface of the photosensitive material drum 21 by the cleaning blade 28. The cleaning blade 28 is bonded with a blade folder 29 formed by forming an iron plate into a plate having a L-shaped cross section.

In the image forming apparatus described above, the wear resistance, toner fusion, blade squeaking and blade turning-over were evaluated by changing the press-contact force f (g/cm) of the cleaning blade 28 to the photosensitive material drum 21 and the press-contact angle (θ) using various positively charged single-layer type photosensitive material drums 21 as the photosensitive material drum 21.

<Production of Single-layer Type Photosensitive Material and Copying Test>

Examples 1 to 42 and
Comparative Examples 1 to 24

4.5 Parts by weight of an X type metal-free phthalocyanine ($PcH_2$) as the electric charge generating material, 30 parts by weight of an electron transferring material (ETM-1), 55 parts by weight of a hole transferring material (HTM-1), 100 parts by weight of a binder resin (Resin-1 to Resin-3) having a weight-average molecular weight of 100,000 and 700 parts by weight of tetrahydrofuran were dispersed or dissolved in a ball mill for 24 hours to prepare a coating solution for single-layer type photosensitive layer. Then, an alumina tube as the substrate was coated with the coating solution according to a dip coating method, followed by hot-air drying at 125° C. for 45 minutes to form single-layer type photosensitive materials having a photosensitive layer of 35 μm in a film thickness. After each of the resulting single-layer type photosensitive materials with the constitution shown in FIG. 2 was installed in a FAX machine with the constitution shown in FIG. 2 (transformed Creage 8331, manufactured by KYOCERA-MITA Co.), a copying test described hereinafter was carried out.

The wear resistance, toner fusion, blade squeaking and blade turning-over of the single-layer type photosensitive materials of the respective Examples and Comparative were evaluated by the following tests.

[Wear Resistance Evaluation Test]

After each of single-layer type photosensitive materials of the respective Examples and Comparative Examples was installed in a FAX machine with the constitution shown in FIG. 2 (transformed Creage 8331, manufactured by KYOCERA-MITA Co.), a copying test (100,000 copied sheets, longitudinal direction of A4 size papers) was carried out by changing the press-contact force f (g/cm) of the cleaning blade and the press-contact angle (θ). The film thickness of the photosensitive layer before and after test was measured and a change in film thickness was calculated. The smaller the change in film thickness, the better the wear resistance. The case where the change in film thickness is 3.0 μm or less was rated "pass", whereas, the case where the change in film thickness is more than 3.0 μm was rated "fail".

[Blade Squeaking, Blade Turning-over Evaluation Test]

During the copying test (100,000 copied sheets), it was auditively or visually examined every 1,000 copied sheets whether or not blade squeaking or blade turning-over occurred. A single-layer type photosensitive material, wherein the number of sheets copied until defects occur is smaller, can be considered as a single-layer type photosensitive material which is less likely to cause blade squeaking or blade turning-over. The case where defects occurred until the number of copied sheets does not reach 50,000 was rated "fail".

[Dash Mark, Toner Filming Evaluation Test]

During the copying test (100,000 copied sheets), a blank manuscript were used every 1,000 papers and a printing test (transverse direction of A4 size papers) was carried out, and then it was examined whether or not dash mark or toner filming occurred at both ends of the drum. Dash mark or toner filming is likely occur at both ends of the drum as the non-image formation portion during the copying test and, in case dash mark or toner filming occurs, the toner fused portion appears as noise image during the copying test (longitudinal direction of A4 size papers). A single-layer type photosensitive material, wherein the number of sheets copied until defects occur is smaller, can be considered as a single-layer type photosensitive material which is less likely to cause dash mark or toner filming. The case where defects occurred until the number of copied sheets does not reach 50,000 was rated "fail".

Figure 3:
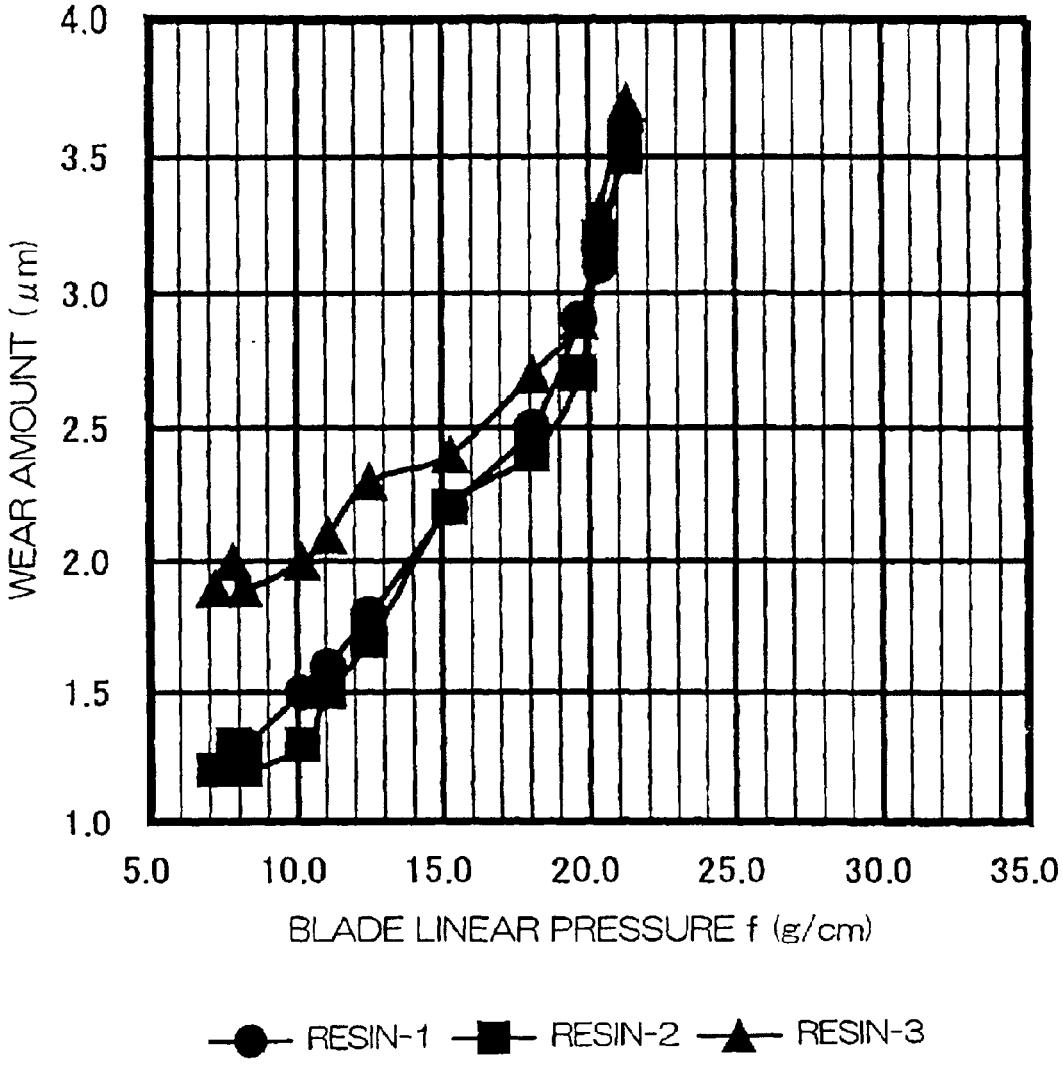
FIG. 3 is a graph showing a relationship between the blade linear pressure f and the wear amount when a blade press-contact angle θ is fixed (18°).

The evaluation test results are shown in Tables 1 to 6. FIGS. 1 to 6 are graphs by plotting data shown in Tables 1 to 6 and show the relationships between the blade linear pressure/press-contact angle and the wear amount (FIG. 1, FIG. 4), the relationships between the blade linear pressure/press-contact angle and the number of copied sheets where dash mark or toner filming occurred (FIG. 2, FIG. 5), and the relationships between the blade linear pressure/press-contact angle and the number of copied sheets where blade squeaking or blade turning-over occurred (FIG. 3, FIG. 6).

TABLE 1

| | Single-layer type photosensitive material | Blade linear pressure (g/cm) | Blade press-contact angle θ (°) | Wear amount (μm) | Number of copied sheets where dash mark and toner filing occurred (×1,000 sheets) | Number of copied sheets where blade squeaking and blade turning-over occurred (×1,000 sheets) |
|---|---|---|---|---|---|---|
| Comp. Example 1 | Resin-1 | 7.2 | 18.0 | 1.2 | 46 | 100 |
| Comp. Example 2 | Resin-1 | 7.8 | 18.0 | 1.3 | 47 | 100 |
| Example 1 | Resin-1 | 8.2 | 18.0 | 1.3 | 54 | 100 |
| Example 2 | Resin-1 | 10.2 | 18.0 | 1.5 | 85 | 100 |
| Example 3 | Resin-1 | 11.1 | 18.0 | 1.6 | 94 | 100 |
| Example 4 | Resin-1 | 12.5 | 18.0 | 1.8 | 98 | 96 |
| Example 5 | Resin-1 | 15.3 | 18.0 | 2.2 | 100 | 90 |
| Example 6 | Resin-1 | 18.1 | 18.0 | 2.5 | 100 | 85 |
| Example 7 | Resin-1 | 19.7 | 18.0 | 2.9 | 100 | 64 |
| Comp. Example 3 | Resin-1 | 20.4 | 18.0 | 3.1 | 100 | 41 |
| Comp. Example 4 | Resin-1 | 21.3 | 18.0 | 3.6 | 100 | 35 |

TABLE 2

| | Single-layer type photosensitive material | Blade linear pressure (g/cm) | Blade press-contact angle θ (°) | Wear amount (μm) | Number of copied sheets where dash mark and toner filing occurred (×1,000 sheets) | Number of copied sheets where blade squeaking and blade turning-over occurred (×1,000 sheets) |
|---|---|---|---|---|---|---|
| Comp. Example 5 | Resin-2 | 7.2 | 18.0 | 1.2 | 49 | 100 |
| Comp. Example 6 | Resin-2 | 7.8 | 18.0 | 1.3 | 50 | 100 |
| Example 8 | Resin-2 | 8.2 | 18.0 | 1.2 | 57 | 100 |
| Example 9 | Resin-2 | 10.2 | 18.0 | 1.3 | 94 | 100 |
| Example 10 | Resin-2 | 11.1 | 18.0 | 1.5 | 100 | 100 |
| Example 11 | Resin-2 | 12.5 | 18.0 | 1.7 | 100 | 100 |
| Example 12 | Resin-2 | 15.3 | 18.0 | 2.2 | 100 | 100 |
| Example 13 | Resin-2 | 18.1 | 18.0 | 2.4 | 100 | 98 |
| Example 14 | Resin-2 | 19.7 | 18.0 | 2.7 | 100 | 78 |
| Comp. Example 7 | Resin-2 | 20.4 | 18.0 | 3.2 | 100 | 49 |
| Comp. Example 8 | Resin-2 | 21.3 | 18.0 | 3.5 | 100 | 47 |

TABLE 3

| | Single-layer type photosensitive material | Blade linear pressure (g/cm) | Blade press-contact angle θ (°) | Wear amount (μm) | Number of copied sheets where dash mark and toner filing occurred (×1,000 sheets) | Number of copied sheets where blade squeaking and blade turning-over occurred (×1,000 sheets) |
|---|---|---|---|---|---|---|
| Comp. Example 9 | Resin-3 | 7.2 | 18.0 | 1.9 | 97 | 100 |
| Comp. Example 10 | Resin-3 | 7.8 | 18.0 | 2.0 | 98 | 100 |
| Example 15 | Resin-3 | 8.2 | 18.0 | 1.9 | 98 | 100 |
| Example 16 | Resin-3 | 10.2 | 18.0 | 2.0 | 100 | 100 |
| Example 17 | Resin-3 | 11.1 | 18.0 | 2.1 | 100 | 100 |
| Example 18 | Resin-3 | 12.5 | 18.0 | 2.3 | 100 | 95 |
| Example 19 | Resin-3 | 15.3 | 18.0 | 2.4 | 100 | 90 |
| Example 20 | Resin-3 | 18.1 | 18.0 | 2.7 | 100 | 83 |
| Example 21 | Resin-3 | 19.7 | 18.0 | 2.9 | 100 | 67 |
| Comp. Example 11 | Resin-3 | 20.4 | 18.0 | 3.3 | 100 | 45 |
| Comp. Example 12 | Resin-3 | 21.3 | 18.0 | 3.7 | 100 | 40 |

TABLE 4

| | Single-layer type photosensitive material | Blade linear pressure (g/cm) | Blade press-contact angle θ (°) | Wear amount (μm) | Number of copied sheets where dash mark and toner filing occurred (×1,000 sheets) | Number of copied sheets where blade squeaking and blade turning-over occurred (×1,000 sheets) |
|---|---|---|---|---|---|---|
| Comp. Example 13 | Resin-1 | 11.0 | 10.5 | 1.2 | 35 | 100 |
| Comp. Example 14 | Resin-1 | 11.0 | 11.5 | 1.3 | 38 | 100 |
| Example 22 | Resin-1 | 11.0 | 12.0 | 1.3 | 51 | 100 |
| Example 23 | Resin-1 | 11.0 | 14.0 | 1.3 | 77 | 100 |
| Example 24 | Resin-1 | 11.0 | 17.0 | 1.4 | 90 | 100 |
| Example 25 | Resin-1 | 11.0 | 20.0 | 1.6 | 95 | 89 |
| Example 26 | Resin-1 | 11.0 | 25.0 | 1.8 | 98 | 81 |
| Example 27 | Resin-1 | 11.0 | 27.0 | 2.2 | 100 | 65 |
| Example 28 | Resin-1 | 11.0 | 30.0 | 2.9 | 100 | 50 |
| Comp. Example 15 | Resin-1 | 11.0 | 30.5 | 3.1 | 100 | 45 |
| Comp. Example 16 | Resin-1 | 11.0 | 31.5 | 3.3 | 100 | 44 |

TABLE 5

| | Single-layer type photosensitive material | Blade linear pressure (g/cm) | Blade press-contact angle θ (°) | Wear amount (μm) | Number of copied sheets where dash mark and toner filing occurred (×1,000 sheets) | Number of copied sheets where blade squeaking and blade turning-over occurred (×1,000 sheets) |
|---|---|---|---|---|---|---|
| Comp. Example 17 | Resin-2 | 21.0 | 10.5 | 1.1 | 40 | 100 |
| Comp. Example 18 | Resin-2 | 11.0 | 11.5 | 1.1 | 40 | 100 |
| Example 29 | Resin-2 | 11.0 | 12.0 | 1.2 | 54 | 100 |
| Example 30 | Resin-2 | 11.0 | 14.0 | 1.3 | 93 | 100 |
| Example 31 | Resin-2 | 11.0 | 17.0 | 1.4 | 100 | 100 |
| Example 32 | Resin-2 | 11.0 | 20.0 | 1.5 | 100 | 100 |
| Example 33 | Resin-2 | 11.0 | 25.0 | 1.9 | 100 | 92 |
| Example 34 | Resin-2 | 11.0 | 27.0 | 2.0 | 100 | 88 |
| Example 35 | Resin-2 | 11.0 | 30.0 | 2.8 | 100 | 65 |
| Comp. Example 19 | Resin-2 | 11.0 | 30.5 | 3.1 | 100 | 49 |
| Comp. Example 20 | Resin-2 | 11.0 | 31.5 | 3.2 | 100 | 49 |

TABLE 6

| | Single-layer type photosensitive material | Blade linear pressure (g/cm) | Blade press-contact angle θ (°) | Wear amount (μm) | Number of copied sheets where dash mark and toner filing occurred (×1,000 sheets) | Number of copied sheets where blade squeaking and blade turning-over occurred (×1,000 sheets) |
|---|---|---|---|---|---|---|
| Comp. Example 21 | Resin-3 | 11.0 | 10.5 | 1.8 | 86 | 100 |
| Comp. Example 22 | Resin-3 | 11.0 | 11.5 | 1.9 | 88 | 100 |
| Example 36 | Resin-3 | 11.0 | 12.0 | 1.9 | 90 | 100 |
| Example 37 | Resin-3 | 11.0 | 14.0 | 2.0 | 95 | 100 |
| Example 38 | Resin-3 | 11.0 | 17.0 | 2.0 | 99 | 100 |
| Example 39 | Resin-3 | 11.0 | 20.0 | 2.2 | 100 | 92 |
| Example 40 | Resin-3 | 11.0 | 25.0 | 2.5 | 100 | 83 |
| Example 41 | Resin-3 | 11.0 | 27.0 | 2.8 | 100 | 66 |
| Example 42 | Resin-3 | 11.0 | 30.0 | 3.0 | 100 | 48 |
| Comp. Example 23 | Resin-3 | 11.0 | 30.5 | 3.1 | 100 | 47 |
| Comp. Example 24 | Resin-3 | 11.0 | 31.5 | 3.4 | 100 | 43 |

Figure 4:
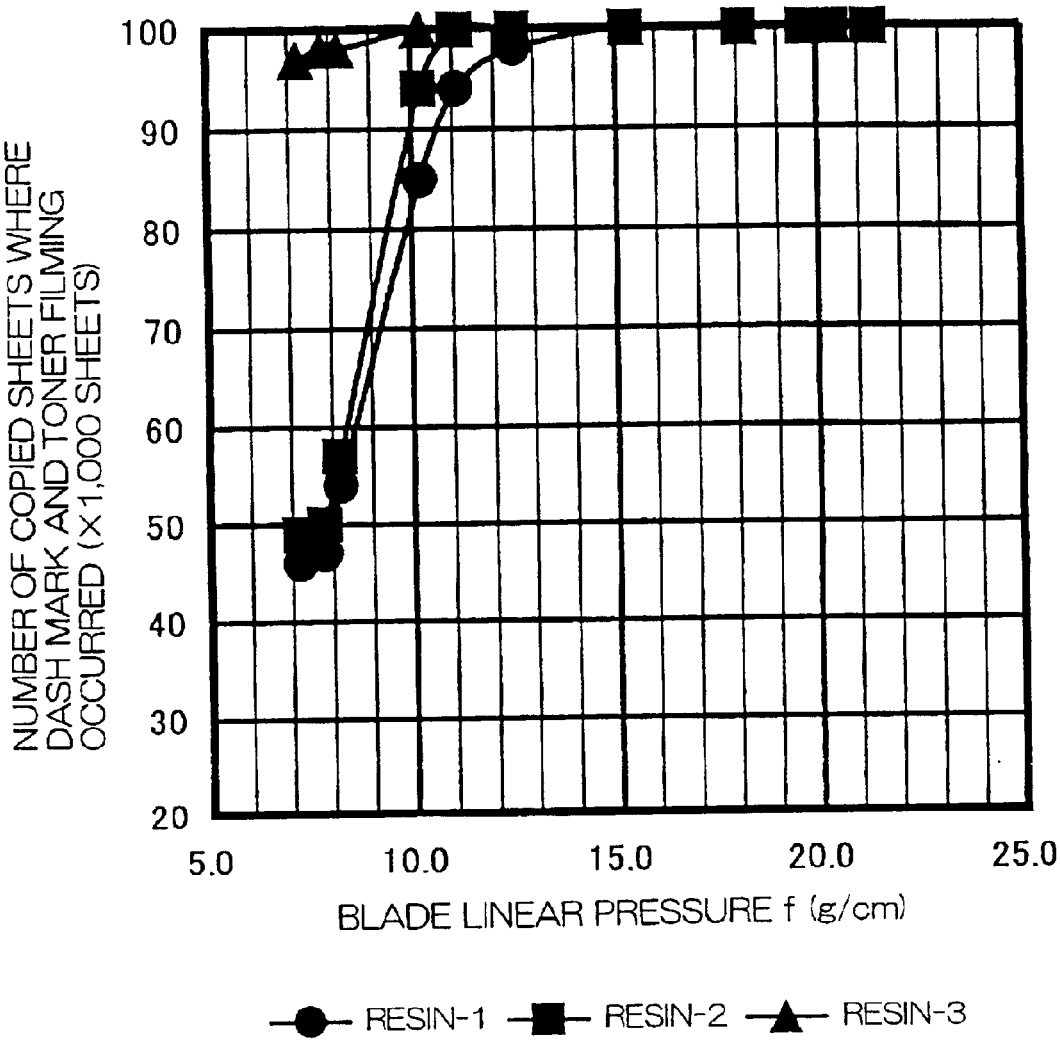
FIG. 4 is a graph showing a relationship between the blade linear pressure f and the number of copied sheets where dash mark or toner filing occurred when a blade press-contact angle θ is fixed (18°).

As is apparent from FIGS. 1 and 4, the wear amount and the blade linear pressure or the blade press-contact angle have a correlation. As the blade linear pressure of press-contact angle increased, the wear amount increased and the wear resistance was lowered. When the linear pressure is 20 g/cm or less or the press-contact angle is 30° or less, the wear amount of the single-layer type photosensitive material was reduced to 3 μm or less.

When using Resin-1 and Resin-2 as the binder resin of the single-layer type photosensitive material, the wear amount was smaller and the wear resistance was better as compared with the case of using Resin-3. This reason is considered that the repeating structural unit (biphenyl type polycarbonate) represented by the general formula [1] effectively acts on an improvement of the wear resistance.

Figure 5:
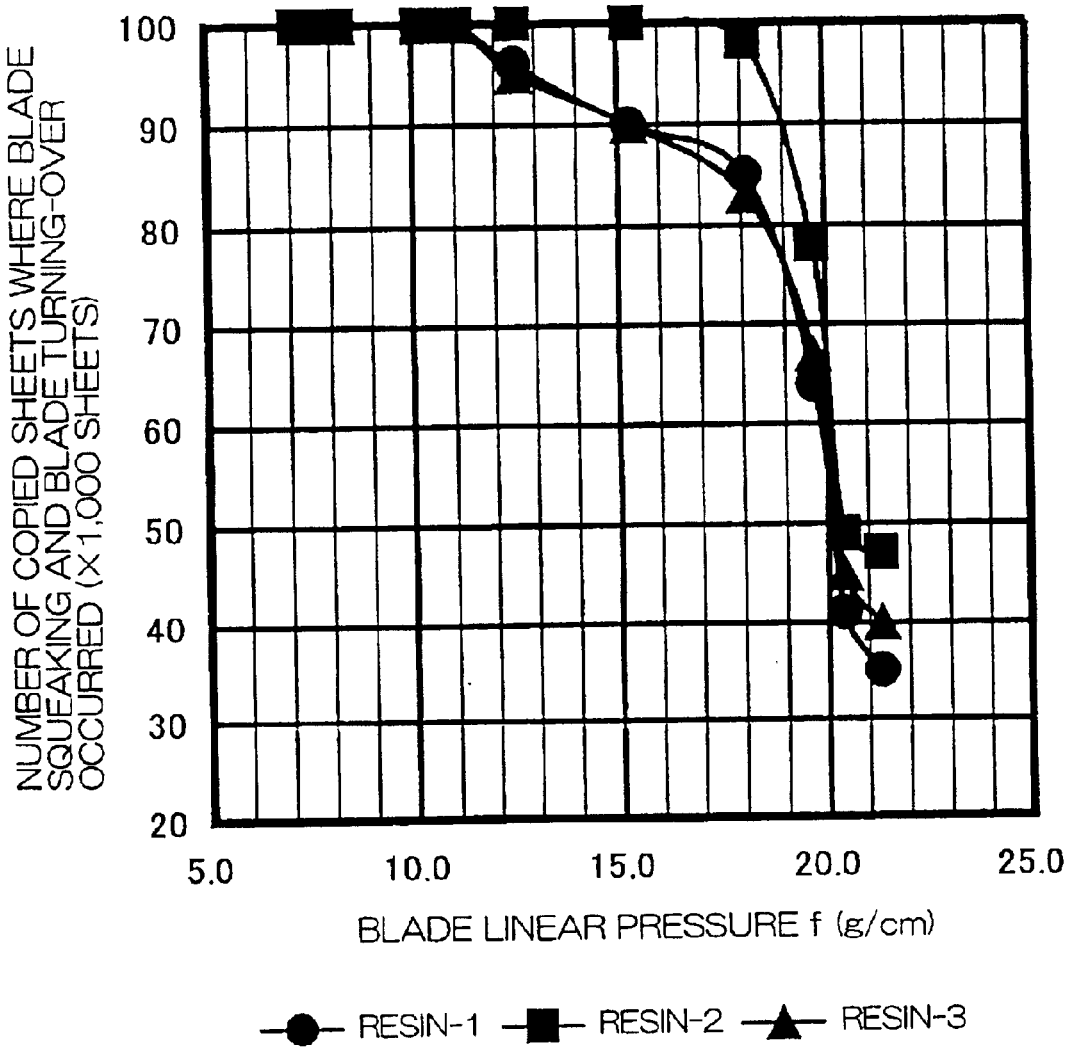
FIG. 5 is a graph showing a relationship between the blade linear pressure f and the number of copied sheets where blade squeaking or blade turning-over occurred when a blade press-contact angle θ is fixed (18°).
Figure 6:
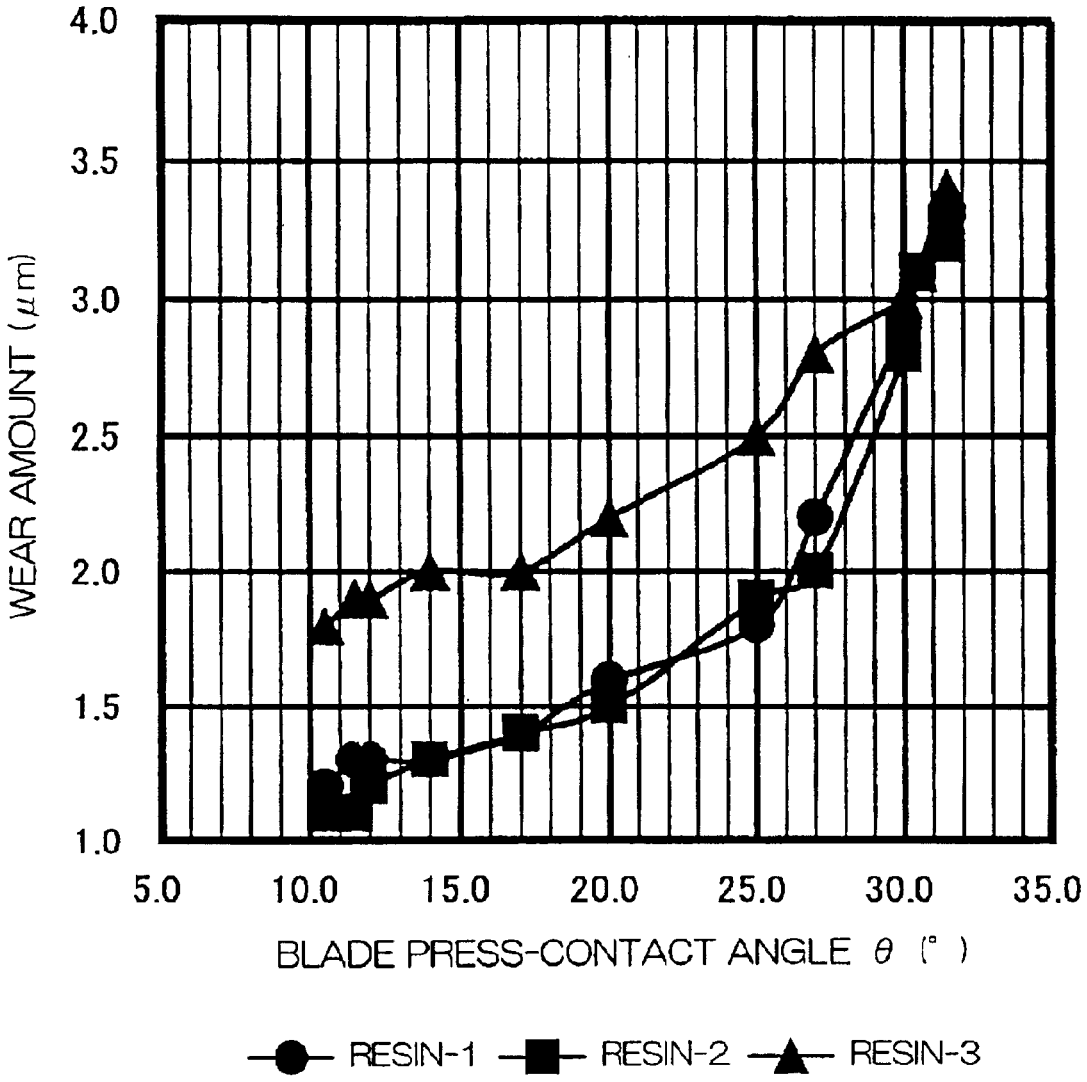
FIG. 6 is a graph showing a relationship between the blade press-contact angle θ and the wear amount when the blade linear pressure f is fixed (11 g/cm).
Figure 7:
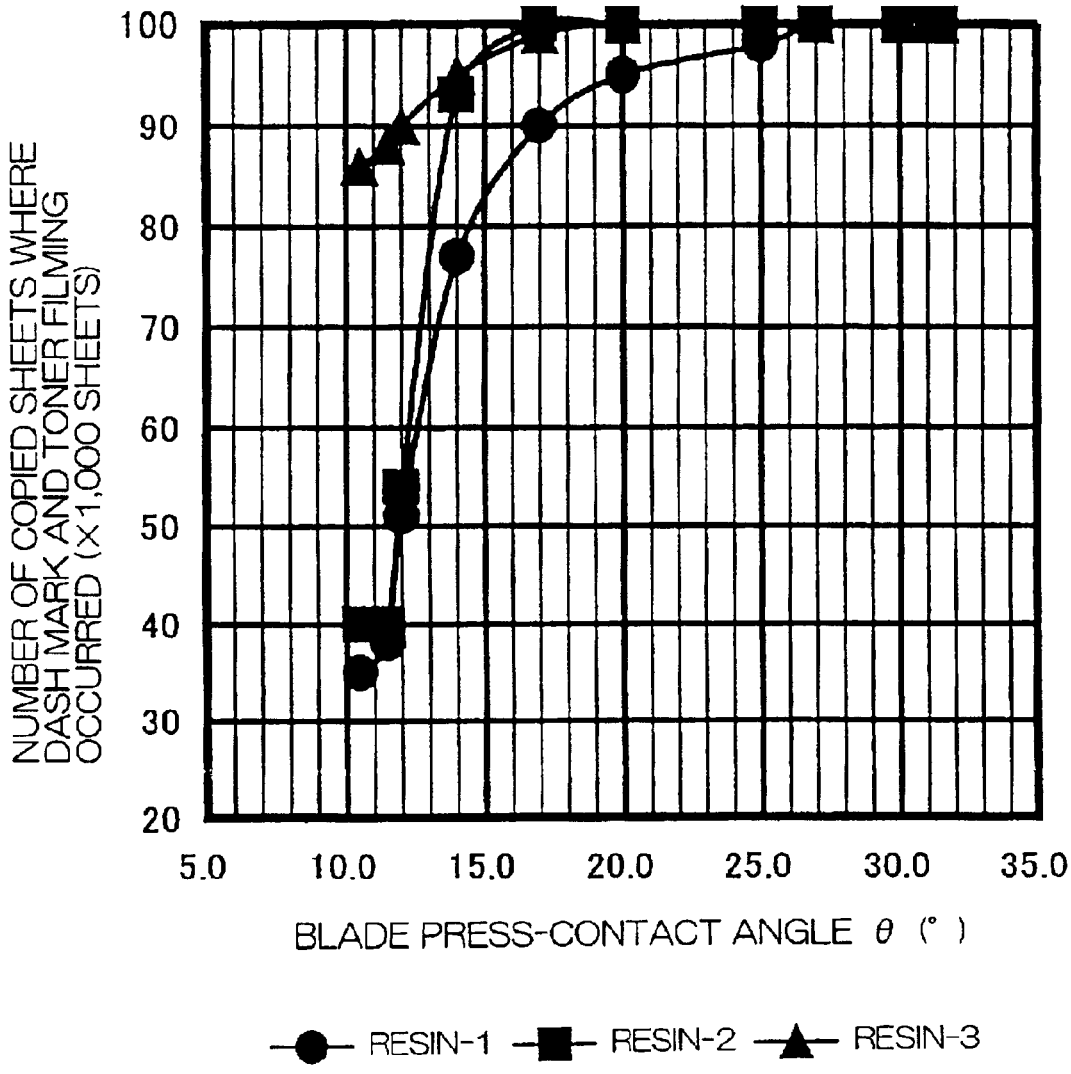
FIG. 7 is a graph showing a relationship between the blade press-contact angle θ and the number copied sheets where dash mark or toner filing occurred when the blade linear pressure f is fixed (11 g/cm).
Figure 8:
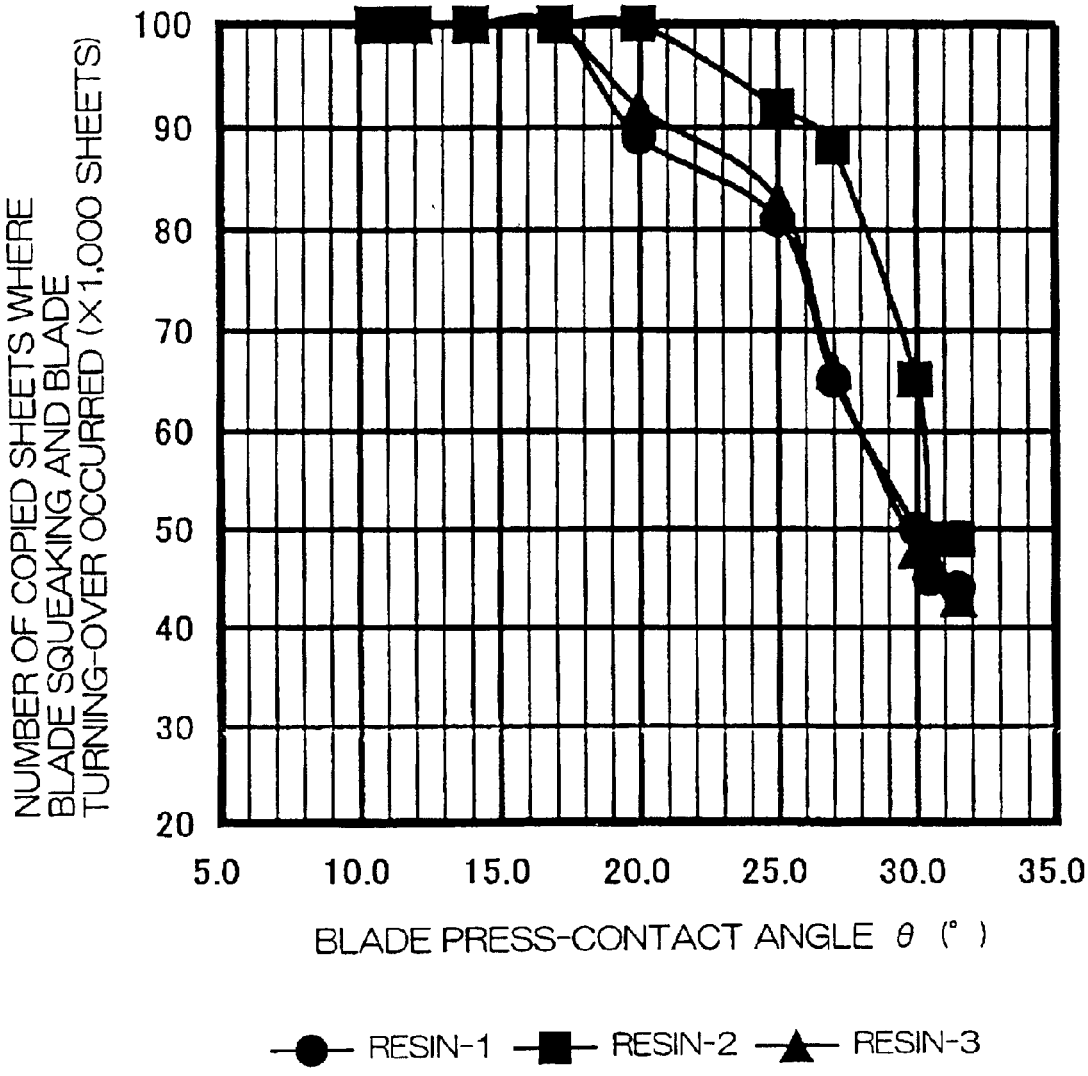
FIG. 8 is a graph showing a relationship between the blade press-contact angle θ and the number of copied sheets where blade squeaking or blade turning-over occurred when the blade linear pressure f is fixed (11 g/cm).

As is apparent from FIGS. 2 and 5, when the linear pressure is 8 g/cm or more or the press-contact angle is 12° or more, dash mark or toner filming did not occur in all single-layer type photosensitive materials until the number of the copied sheets does not reach 50,000. When the linear pressure is 10 g/cm or more or the press-contact angle is 15° or more, dash mark or toner filming did not occur in all single-layer type photosensitive materials until the number of the copied sheets does not reach 80,000.

When using Resin-2, the number of the copied sheets until defects occur at the same linear pressure and the same press-contact angle tended to be larger as compared with the case of using Resin-1. This reason is considered that the repeating structural unit (siloxane-containing polycarbonate) represented by the general formula [3] exerted an effect of reducing the surface energy of the single-layer type photosensitive material, thereby to prevent toner fusion.

When using Resin-3, toner fusion was less likely to occur. This reason is considered that the single-layer type photosensitive material using Resin-3 has poor wear resistance and, therefore, the fused toner is liable to be skived together with the photosensitive layer. From the results, it has been found that the toner fusion is liable to be caused by improving the wear resistance.

As is apparent from FIGS. 3 and 6, when the linear pressure is 20 g/cm or less or the press-contact angle is 30° or less, blade squeaking or blade turning-over did not occur in all single-layer type photosensitive materials until the number of the copied sheets does not reach 50,000. When the linear pressure is 18 g/cm or less or the press-contact angle is 25° or less, blade squeaking or blade turning-over did not occur in all single-layer type photosensitive materials until the number of the copied sheets does not reach 80,000.

When using Resin-2, the number of the copied sheets until blade squeaking or blade turning-over occurs at the same linear pressure and the same press-contact angle tended to be larger as compared with the case of using Resin-1 or Resin-3. This reason is considered that the repeating structural unit (siloxane-containing polycarbonate) represented by the general formula [3] improves the surface smoothness of the single-layer type photosensitive material, thereby to effectively act on the reduction of a friction coefficient with the blade.

As is apparent from the results described above, when the linear pressure is not less than 8 g/cm and not more than 20 g/cm and the press-contact angle is not less than 12° or more and not more than 30°, the wear amount is not more than 3 μm and neither dash mark or toner filming, nor blade squeaking or blade turning-over did not occur in all single-layer type photosensitive materials until the number of the copied sheets does not reach 50,000.

When the linear pressure is not less than 10 g/cm and not more than 18 g/cm and the press-contact angle is not less than 15° or more and not more than 25°, neither dash mark or toner filming, nor blade squeaking or blade turning-over did not occur in all single-layer type photosensitive materials until the number of the copied sheets does not reach 80,000, which was further preferred.

In case the binder resin of the single-layer type photosensitive material contains a polycarbonate resin having a repeating structural unit of the general formula [1] or the general formula [3] (Resin-1 or Resin-3), it is further effective to improve the wear resistance and to prevent blade squeaking or blade turning-over.

[Image Forming Apparatus 2]

Figure 9:
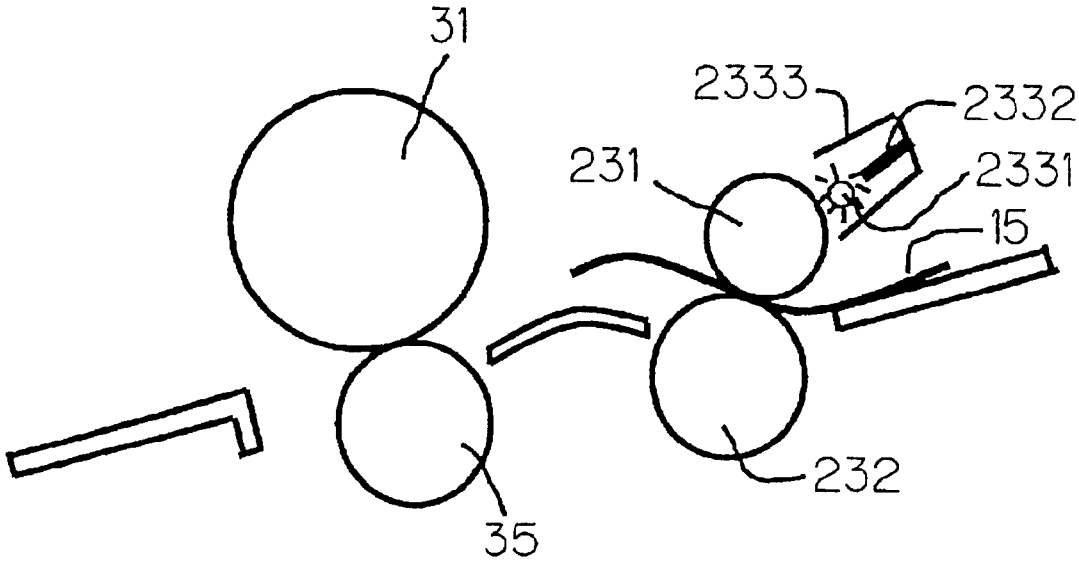
FIG. 9 is a view showing an enlarged model in the vicinity of resist roller constituted as paper transporting rollers equipped with a function of removing paper powders in the image forming apparatus of the present invention.

FIG. 9 is a view showing an enlarged model in the vicinity of resist rollers as paper transporting rollers equipped with a paper powders removing function among the image forming apparatuses using the single-layer type photosensitive material of the present invention. As shown in FIG. 9, a pair of resist rollers are arranged at the upper stream side on a path for transporting a transfer paper from a paper feeding portion to the, and has a function of controlling timing of sending a transfer paper 15 to a transferring portion of the image forming portion and a function of transporting to the image forming portion after truing up the tip portion of the transfer paper when the transfer paper 15 was sent in the inclined state. A pair of resist rollers are composed of a first resist roller 231 located at the side (surface to be transferred) onto which the toner image is transferred, the transfer paper 15 facing the single-layer type photosensitive material drum 31 at the image forming portion, a second resist roller 232 located opposite the transfer paper 15, and a cleaner 233 for removing paper powders adsorbed on the first resist roller.

At least the surface layer of the first resist roller 231 is made of a cylindrical material of polyoxymethylene (POM) and the surface of the second resist roller 232 is made of a cylindrical material of an ethylenepropylene (EPDM) rubber capable of attaining a sufficiently large contact friction force between the second resist roller and the transfer paper 15.

In case the transfer paper 15 and paper powders pass through the first resist roller 231, the paper powders are adsorbed on the first resist roller 231 by friction charge. The paper powders are adsorbed on the first resist roller 231 are removed by the cleaner 233. The cleaner 233 is composed of a brush roller 2331, a dusting plate 2332 and a housing 2333. The brush roller 2331 is flocked with polyester fibers and is contacted with the first resist roller 231 while being rotated with facing the first resist roller, thereby to adhere the paper powders onto the brush roller 2331. The paper powders adhered onto the brush roller 2331 are removed by the dusting plate 2332 and then accumulated in the housing 2333, while the paper powders adsorbed onto the first resist roller 231 are removed.

Therefore, the paper powders adhered onto the transfer paper 15 are removed before transporting to the image forming portion, thereby making it possible to prevent contamination on the surface of the single-layer type photosensitive material drum 31 due to filler contained in the paper powders, thus causing neither dash mark nor toner filming. Accordingly, the image quality of the image transferred onto the transfer paper 15 can be prevented from lowering.

<Production of Single-layer Type Photosensitive Material and Copying Test>

Examples 43 to 48 and
Comparative Examples 25 to 29

3.5 Parts by weight of an electric charge generating material (X type metal-free phthalocyanine), 10 to 50 parts by weight of an electron transferring material (ETM-1), 10 to 60 parts by weight of a hole transferring material (HTM-1), 100 parts by weight of a binder resin (Resin-1) having a weight-average molecular weight of 100,000 and 700 parts by weight of tetrahydrofuran were dispersed or dissolved in a ball mill for 24 hours to prepare a coating solution for single-layer type photosensitive layer. Then, an alumina tube as the substrate was coated with the coating solution according to a dip coating method, followed by hot-air drying at 120° C. for 30 minutes to form single-layer type photosensitive materials having a single photosensitive layer of 35 μm in a film thickness. After each of the resulting single-layer type photosensitive materials was installed in the image forming apparatus described hereinafter, which has a paper powders removing means shown in FIG. 9, a copying test (100,000 copied sheets) was carried out.

Examples 49 and 50

In the same manner as in Example 4, except that 100 parts by weight of a binder resin (Resin-4, Resin-3) having a weight-average molecular weight of 100,000 was used, single-layer type photosensitive materials were produced. After each of the resulting single-layer type photosensitive materials was installed in the image forming apparatus described hereinafter, which has a paper powders removing means shown in FIG. 9, a copying test (100,000 copied sheets) was carried out.

Comparative Examples 30 to 32

After each of the single-layer type photosensitive materials produced in Examples 46, 49 and 50 was installed in the image forming apparatus described hereinafter, which has no paper powders removing means, a copying test (100,000 copied sheets) was carried out.

The wear resistance, toner fusion and electrical characteristics of the photosensitive material were evaluated by the following tests.

[Wear Resistance Evaluation Test]

After each single-layer type photosensitive material was installed in an image forming apparatus having a paper powders removing means shown in FIG. 9 (transformed Creage 7340, manufactured by KYOCERA-MITA Co.) or an image forming apparatus having no paper powders removing means (transformed Creage 7340, manufactured by KYOCERA-MITA Co.), a copying test (100,000 copied sheets, longitudinal direction of A4 size papers) was carried out. The film thickness of the photosensitive layer before and after test was measured and a change in film thickness was calculated. The smaller the change in film thickness, the better the wear resistance. The case where the change in film thickness is 3.0 μm or less was rated "pass", whereas, the case where the change in film thickness is more than 3.0 μm was rated "fail".

[Dash Mark, Toner Filming Evaluation Test]

During the copying test (100,000 copied sheets), a blank manuscript were used every 5,000 papers and a printing test (transverse direction of A4 size papers) was carried out, and then it was examined whether or not dash mark or toner filming occurred at both ends of the drum. Dash mark or toner filming occurred at both ends of the drum as the non-image formation portion during the copying test (transverse direction of A4 size papers) and, in case dash mark or toner filming occurs, the toner fused portion appears as noise image during the copying test (transverse direction of A4 size papers).

[Sensitivity Evaluation Test]

Using a drum sensitivity tester manufactured by GEN-TEC Co., a voltage was applied to the surface of each single-layer type photosensitive material before and after copying test (100,000 copied sheets), thereby to charge the surface at +700 V. The surface of each photosensitive material was irradiated with monochromic light having a wavelength of 780 nm (half-width: 20 nm, light intensity: 1.0 $\mu J/cm^2$) from white light of a halogen lamp as an exposure light source through a band-pass filter, and then a surface potential at the time at which 0.5 seconds have passed since the beginning of exposure was measured as a residual potential ($V_L$). The smaller the residual potential $V_L$, the higher the sensitivity of the photosensitive material. The case where the residual potential $V_L$ is 125 V or less was rated "pass", whereas, the case where the residual potential $V_L$ is more than 120 V was rated "fail".

The sensitivity change ratio (%) was calculated by the following equation. The case where the sensitivity change ratio is 10% or less was rated "pass", whereas, the case where the change in sensitivity more than 10% was rated "fail".

$$[\text{Sensitivity change ratio } (\%)]=[(V_L \text{ after copying test})-(V_L \text{ before copying test})/(V_L \text{ before copying test})]\times 100$$

Figure 10:
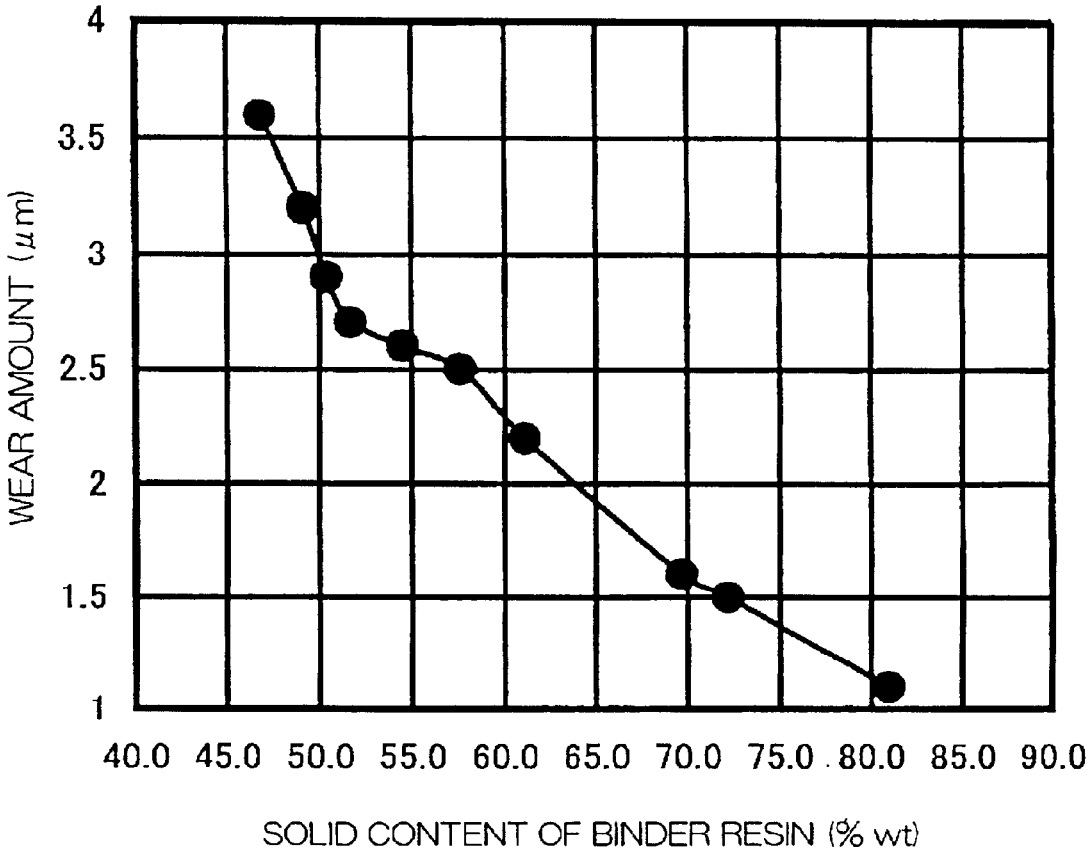
FIG. 10 is a graph showing a relationship between the solid content of a binder resin based on the total solid content of a single-layer type photosensitive material and the wear amount of a photosensitive layer.
Figure 11:
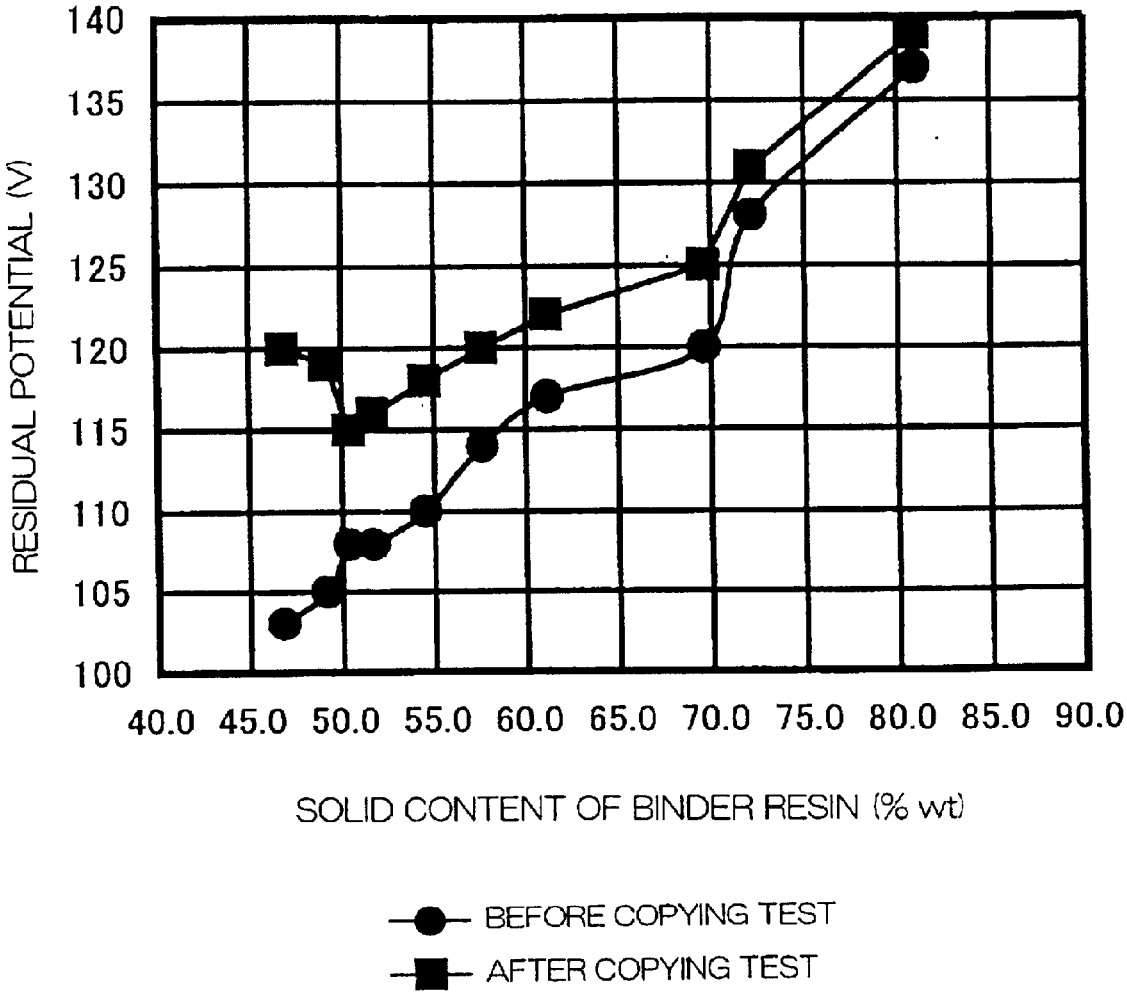
FIG. 11 is a graph showing a relationship between the solid content of a binder resin based on the total solid content of a single-layer type photosensitive material and the residual potential $V_L$ (before and after copying test).
Figure 12:
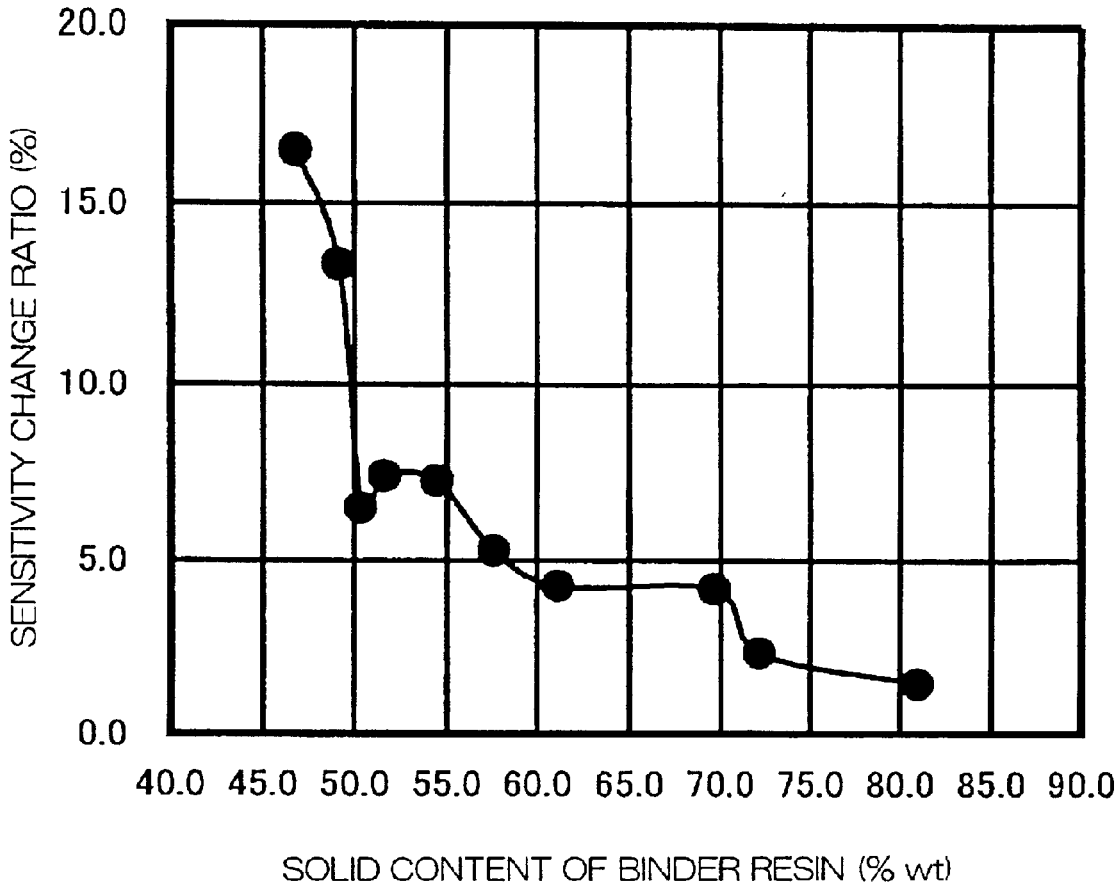
FIG. 12 is a graph showing a relationship between the solid content of a binder resin based on the total solid content of a single-layer type photosensitive material and the sensitivity change ratio.

The evaluation test results are shown in Tables 7, 8 and 9. The relationships between the solid content of the binder resin based on the whole solid content and the wear amount of the photosensitive layer, the residual potential $V_L$ the sensitivity change ratio are shown in FIGS. 10 to 12.

TABLE 7

| | HTM-1 (parts by weight) | ETM-1 (parts by weight) | Solid content of binder resin (% by weight) | Binder resin | Image forming conditions | Wear amount (μm) |
|---|---|---|---|---|---|---|
| Example 43 | 20 | 20 | 69.7 | Resin-1 | with paper powders removing means | 1.6 |
| Example 44 | 30 | 30 | 61.2 | Resin-1 | with paper powders removing means | 2.2 |
| Example 45 | 40 | 30 | 57.6 | Resin-1 | with paper powders removing means | 2.5 |
| Example 46 | 50 | 30 | 54.5 | Resin-1 | with paper powders removing means | 2.6 |
| Example 47 | 50 | 40 | 51.7 | Resin-1 | with paper powders removing means | 2.7 |
| Example 48 | 55 | 40 | 50.4 | Resin-1 | with paper powders removing means | 2.9 |
| Comp. Example 26 | 10 | 10 | 81.0 | Resin-1 | with paper powders removing means | 1.1 |

TABLE 7-continued

| | | | | | | |
|---|---|---|---|---|---|---|
| Comp. Example 27 | 20 | 15 | 72.2 | Resin-1 | with paper powders removing means | 1.5 |
| Comp. Example 28 | 55 | 45 | 49.1 | Resin-1 | with paper powders removing means | 3.2 |
| Comp. Example 29 | 60 | 50 | 46.8 | Resin-1 | with paper powders removing means | 3.6 |

| | | Residual potential (V) | | Sensitivity |
|---|---|---|---|---|
| | Dash mark, toner filming | Before copying test | After copying test | change ratio (%) |
| Example 43 | none | 120 | 125 | 4.2 |
| Example 44 | none | 117 | 122 | 4.3 |
| Example 45 | none | 114 | 120 | 5.3 |
| Example 46 | none | 110 | 118 | 7.3 |
| Example 47 | none | 108 | 116 | 7.4 |
| Example 48 | none | 108 | 115 | 6.5 |
| Comp. Example 26 | none | 137 | 139 | 1.5 |
| Comp. Example 27 | none | 128 | 131 | 2.3 |
| Comp. Example 28 | none | 105 | 119 | 13.3 |
| Comp. Example 29 | none | 103 | 120 | 16.5 |

TABLE 8

| | HTM-1 (parts by weight) | ETM-1 (parts by weight) | Solid content of binder resin (% by weight) | Binder resin | Image forming conditions | Wear amount (μm) |
|---|---|---|---|---|---|---|
| Example 46 | 50 | 30 | 54.5 | Resin-1 | with paper powders removing means | 2.6 |
| Example 49 | 50 | 30 | 54.5 | Resin-4 | with paper powders removing means | 2.7 |
| Example 50 | 50 | 30 | 54.5 | Resin-3 | with paper powders removing means | 2.9 |

| | | Residual potential (V) | | |
|---|---|---|---|---|
| | Dash mark, toner filming | Before copying test | After copying test | Sensitivity change ratio (%) |
| Example 46 | none | 110 | 118 | 7.3 |
| Example 49 | none | 116 | 126 | 8.6 |
| Example 50 | none | 108 | 118 | 9.3 |

TABLE 9

| | Binder resin | Image forming conditions | Wear amount (μm) | Dash mark, toner filming |
|---|---|---|---|---|
| Example 46 | Resin-1 | no paper powders removing means | 2.6 | occurred after copying 55,000 sheets |
| Comp. Example 30 | Resin-2 | no paper powders removing means | 2.7 | occurred after copying 60,000 sheets |
| Comp. Example 31 | Resin-3 | no paper powders removing means | 2.9 | occurred after copying 80,000 sheets |

As is apparent from Table 7 or FIGS. 10 to 12, when each of single-layer type photosensitive materials wherein the solid content of the binder resin is within a range from 50 to 70% by weight was subjected to a copying test using an image forming apparatus having a paper powders removing means, the wear amount of the photosensitive layer was 3.0 μm or less and neither dash mark nor toner filming occurred and, moreover, the initial residual potential $V_L$ was 120 V or less and the sensitivity change ratio was 10% or less.

To the contrary, in case of the single-layer type photosensitive materials wherein the solid content of the binder resin is less than 50% by weight, although the wear amount of the photosensitive layer was more than 3.0 μm and the initial residual potential $V_L$ was less than the value described above, the sensitivity change ratio was more than 10%. Neither dash mark nor toner filming occurred.

In case of the single-layer type photosensitive materials wherein the solid content of the binder resin is more than 70% by weight, although the wear amount of the photosensitive layer was 3.0 μm or less, the initial residual potential $V_L$ was more than 120 V. Neither dash mark nor toner filming occurred.

As is apparent from Table 8, comparing by changing only the kind of the binder resin, when using polycarbonate resin (Resin-1, Resin-4) of a polycarbonate resin having repeating structural units represented by the general formulas [1] and [2], the wear amount of the photosensitive layer was reduced and the wear resistance was good. Neither dash mark nor toner filming occurred.

As is apparent from Table 9, when a copying test was carried out using an image forming apparatus having no paper powders removing means, dash mark and toner filming occurred even if any single-layer photosensitive layer was used. In case of the single-layer photosensitive layer having better wear resistance, dash mark and toner filming occurred at an early stage.

What is claimed is:

1. An image forming apparatus comprising a rotatable image carrier, and a charging means, an exposing means, a developing means, a transferring means and a cleaning means, which are sequentially arranged in the vicinity of the rotatable image carrier, wherein a toner remaining on the surface of the rotatable image carrier is removed by the cleaning means after going through the developing means and the transferring means;

said cleaning means has an elastic blade, which is supported by a supporting member and is contacted with the surface of the image carrier at a contact pressure of not less than 8 g/cm and not more than 20 g/cm in terms of a linear pressure, and a press-contact angle of the elastic blade is not less than 12° and not more than 30°; and said image carrier is an organic electrophotosensitive material comprising a conductive substrate, and a single-layer type photosensitive layer made of a binder resin containing at least an electric charge generating material, an electric charge transferring material, and a hole transferring material, which is formed on the conductive substrate;

wherein the solid content of the binder resin is not less than 50% by weight and not more than 70% by weight based on the whole solid content in the photosensitive layer and, moreover, a pair of paper transporting rollers are arranged on a path for transporting a transfer paper from a paper feeding portion to the transferring means, and a paper transporting roller at the side to be transferred among the pair of paper transporting rollers has a cleaning means for removing paper powders adsorbed on the paper transporting roller at the side of the surface to be transferred from the roller, wherein said paper rollers are composed of a first roller located at the side onto which a toner image is transferred and a second roller located opposite the transfer paper, wherein at least the surface layer of the first roller is a cylindrical material of polyoxymethylene (POM), the surface of the second roller is a cylindrical material of an ethyleneepropylene (EPDM) rubber and the cleaning means is composed of a brush roller flocked with polyester fibers, a dusting plate, and a housing.

2. The image forming apparatus according to claim 1, wherein the linear pressure is not less than 10 g/cm and not more than 18 g/cm.

3. The image forming apparatus according to claim 1, wherein the linear pressure is not less than 10 g/cm and not more than 18 g/cm and the press-contact angle is not less than 15° and not more than 25°.

4. The image forming apparatus according to claim 1, wherein, in the electrophotosensitive material, the binder resin in the photosensitive layer is a copolymerized polycarbonate resin having a repeating structural unit represented by the general formula [1]:

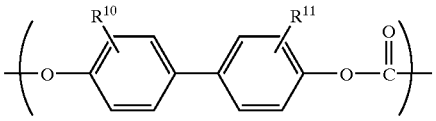

wherein $R^{10}$ and $R^{11}$ are the same or different and represent a hydrogen atom or an alkyl group having 1 to 3 carbon atoms, and a repeating structural unit represented by the general formula [2]:

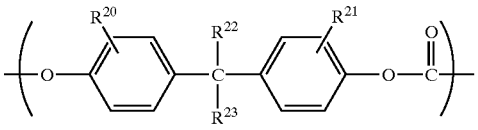

wherein $R^{20}$ and $R^{21}$ are the same or different and represent a hydrogen atom, an alkyl group having 1 to 3 carbon atoms, or a phenyl group, and $R^{22}$ and $R^{23}$ are the same or different and represent an alkyl group having 1 to 3 carbon atoms, a phenyl group, or a cycloalkylidene group which may form a ring to have a substituent.

5. The image forming apparatus according to claim 4, wherein the content of the repeating structural unit represented by the general formula [1] in the copolymerized polycarbonate is within a range from 10 to 50 mol % based on the total amount of the binder resin of the photosensitive layer.

6. The image forming apparatus according to claim 4, further comprising a repeating structural unit represented by the general formula [3]:

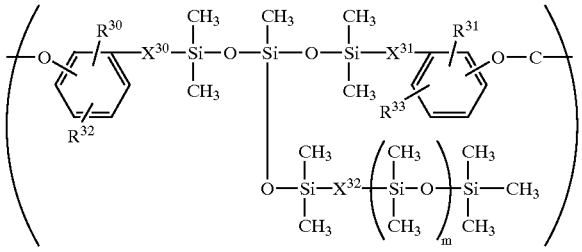

wherein $X^{30}$, $X^{31}$ and $X^{32}$ are the same or different and represent $-(CH_2)_n-$ (n represents an integer of 1 to 6), $R^{30}$, $R^{31}$, $R^{32}$ and $R^{33}$ are the same or different and represent a hydrogen atom, a phenyl group, or an alkyl or alkoxy group having 1 to 3 carbon atoms, and m represents a numerical value of 0 to 200, and wherein the content of the repeating structural unit represented by the general formula [3] in the copolymerized polycarbonate is within a range from 0.05 to 10 mol % based on the total amount of the binder resin of the photosensitive layer.

7. The image forming apparatus according to claim 1, wherein, in the electrophotosensitive material, the binder resin in the photosensitive layer is a copolymerized polycarbonate resin having a repeating structural unit represented by the general formula [1]:

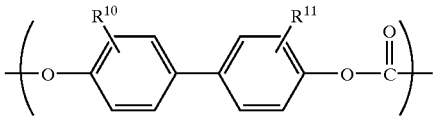

wherein $R^{10}$ and $R^{11}$ are the same or different and represent a hydrogen atom or an alkyl group having 1 to 3 carbon atoms.

8. The image forming apparatus according to claim 7, wherein the content of the repeating structural unit represented by the general formula [1] in the copolymerized polycarbonate is within a range from 10 to 50 mol % based on the total amount of the binder resin of the photosensitive layer.

9. The image forming apparatus according to claim 1, wherein, in the electrophotosensitive material, the binder resin in the photosensitive layer is a copolymerized polycarbonate resin having a repeating structural unit represented by the general formula [1]:

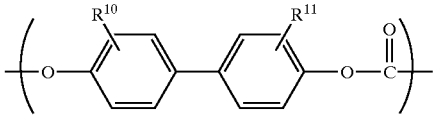

wherein $R^{10}$ and $R^{11}$ are the same or different and represent a hydrogen atom or an alkyl group having 1 to 3 carbon atoms, a repeating structural unit represented by the general formula [2]:

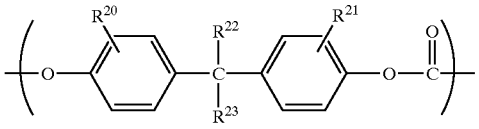

wherein $R^{20}$ and $R^{21}$ are the same or different and represent a hydrogen atom, an alkyl group having 1 to 3 carbon atoms, or a phenyl group, and $R^{22}$ and $R^{23}$ are the same or different and represent an alkyl group having 1 to 3 carbon atoms, a phenyl group, or a cycloalkylidene group which may form a ring to have a substituent, and a repeating structural unit represented by the general formula [3]:

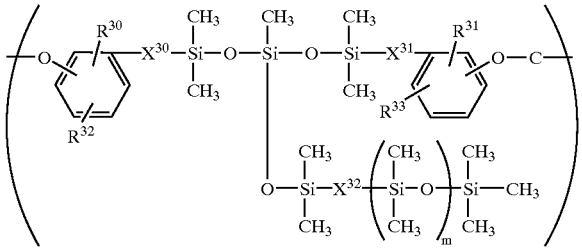

wherein $X^{30}$, $X^{31}$ and $X^{32}$ are the same or different and represent $-(CH_2)_n-$ (n represents an integer of 1 to 6), $R^{30}$, $R^{31}$, $R^{32}$ and $R^{33}$ are the same or different and represent a hydrogen atom, a phenyl group, or an alkyl or alkoxy group having 1 to 3 carbon atoms, and m represents a numerical value of 0 to 200.

10. The image forming apparatus according to claim 9, wherein the content of the repeating structural unit represented by the general formula [1] in the copolymerized polycarbonate is within a range from 10 to 50 mol % based on the total amount of the binder resin of the photosensitive layer.

11. The image forming apparatus according to claim 1, wherein, in the electrophotosensitive material as the image carrier, the binder resin contains, as a main component, a polycarbonate resin having a repeating structural unit represented by the general formula [4]:

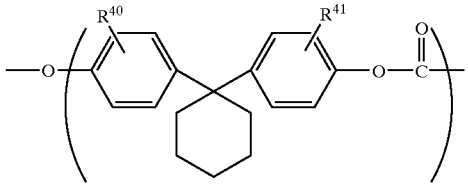

wherein $R^{40}$ and $R^{41}$ are the same or different and represent a hydrogen atom or an alkyl group having 1 to 3 carbon atoms, provided that $R^{40}$ and $R^{41}$ are not simultaneously hydrogen atoms.

* * * * *